US006795066B2

(12) United States Patent
Tanaka et al.

(10) Patent No.: US 6,795,066 B2
(45) Date of Patent: Sep. 21, 2004

(54) DISPLAY APPARATUS AND DRIVING METHOD OF SAME

(75) Inventors: Kyoushi Tanaka, Osaka (JP); Hisashi Nagata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 447 days.

(21) Appl. No.: 10/041,902

(22) Filed: Jan. 8, 2002

(65) Prior Publication Data

US 2002/0093473 A1 Jul. 18, 2002

(30) Foreign Application Priority Data

Jan. 12, 2001 (JP) ..... 2001-005794
Nov. 15, 2001 (JP) ..... 2001-350684

(51) Int. Cl.[7] ..... G09G 5/00
(52) U.S. Cl. ..... 345/204
(58) Field of Search ..... 345/204, 205, 345/87, 89, 96, 97, 98, 100

(56) References Cited

U.S. PATENT DOCUMENTS 5,337,319 A * 8/1994 Furukawa et al. ..... 714/3
5,973,657 A * 10/1999 Okada et al. ..... 345/89
2002/0036625 A1 * 3/2002 Nakamura ..... 345/204
2003/0080951 A1 * 5/2003 Fujiwara et al. ..... 345/204

FOREIGN PATENT DOCUMENTS

EP 0 406 073 A1 * 6/1990
JP 60-50573 4/1985
JP 2-210492 8/1990
JP 3-271795 12/1991
JP 5-232447 9/1993
JP 6-342148 12/1994
JP 9-107563 4/1997
JP 10-10489 1/1998

OTHER PUBLICATIONS

U.S. patent application Ser. No. 09/856,926, Tsuda et al., filed May 2001.

"*Multi–Field Driving Method for Reducing LCD Power Consumption*" (H. Okumura, et al., SID 95 Digest, 1995, pp. 249–252).

* cited by examiner

*Primary Examiner*—Richard Hjerpe
*Assistant Examiner*—Ronald Laneau
(74) *Attorney, Agent, or Firm*—David G. Conlin; Steven M. Jensen; Edwards & Angell, LLP

(57) ABSTRACT

A method of driving a display apparatus including a screen which has pixels arranged in a matrix applies a scanning signal to scanning signal lines connected to the pixels and thus selects each line to scan the screen and also supplies a data signal to those pixels on the selected line via data signal lines, so as to produce a display. Under these conditions, after the screen is scanned twice or more, there is provided a idle period T2 in which all the scanning signal lines are caused to be in a non-scanning state for a period longer than a scanning period T1 in which the screen is scanned once.

32 Claims, 21 Drawing Sheets

DISPLAY APPARATUS AND DRIVING METHOD OF SAME

FIELD OF THE INVENTION

The present invention relates to reduction of electricity consumption of a matrix-type display apparatus.

BACKGROUND OF THE INVENTION

Recently, there has been a rapid acceleration in application of liquid crystal display apparatuses in apparatuses, such as word processors, lap top-type personal computers, and pocket-sized televisions. Among the liquid crystal display apparatuses, especially, a reflection-type liquid crystal display apparatus (LCD) draws an attention. Because display of the reflection-type LCD is carried out by reflecting incident light from an outside, the reflection-type LCD requires no back light, thus contributing to low electricity consumption and thin thickness, which leads to a light weight of apparatuses using the LCD of the reflection type.

Conventional LCDs of the reflection type are broadly classified into (a) one using a segment display method, (b) one using a simple multiplex driving method, and (c) one using an active matrix driving method. By using the segment display method, it is possible to display only simple numbers or pictorial symbols, which are used in watches and the like. The simple multiplex driving method and the active matrix driving method, which uses an active element such as a Thin Film Transistor (TFT), can be used for complicated displays of personal computers, portable information terminals and the like. It is desired commonly for all the three methods to have a lower electricity consumption.

As a method of reducing the electricity consumption of the segment display method, Japanese Unexamined Patent Application, Tokukaihei, No. 5-232447 (published on Sep. 10, 1993) discloses that identical potential is applied into a common electrode and a segment electrode so as to acquire a stable display totally in white or black color during a standby time, that is, while no image is displayed and displayed is an all-while display or an all black-display. Moreover, Japanese Unexamined Patent Application, Tokukaihei, No. 2-210492 (published on Aug. 21, 1990) discloses a method for making a high impedance state in an MOS transistor, which directly drives a liquid crystal during the standby time, so that electricity consumption of a driving circuit is reduced. Because the prior arts are for the LCD using the segment display method, the prior arts are limited to display the simple numbers and pictorial symbols, and cannot be applied to those apparatuses such as the personal computers and the portable information terminals, which display complicated information.

Furthermore, it is difficult to employ those driving methods in a matrix-type liquid crystal display apparatus. Going into details, for example, a matrix-type LCD of 4×4 size as shown in FIG. 15 have scanning signals as shown in FIG. 16. The scanning signals are respectively supplied to scanning signal lines G(0) to G(3), so that a selective voltage is applied in order into the scanning signals G(0) to G(3). In a synchronizing manner with the scanning signals of the thus selected respective scanning lines, data signals are supplied to data signal lines S(0) to S(3), so as to write in each pixel an electric charge, which is in accordance with a data. After scanning of a bottom line and a vertical blanking period of a short time, scanning is started again from a first line, as shown in FIG. 17. An original reason why the vertical blanking period is provided is to have a period during which an electron beam from an electron gun, which is provided inside a CRT, can return to its original position. Therefore, LCDs actually requires no vertical blanking period. However, in order to reproduce a general television image or the like on LCDs, the vertical blanking period is provided to LCDs so as to give a compatibility to LCDs with respect to television images according to NTSC (National Television System Committee) or the like.

As discussed above, in case of the matrix-type LCD, it is necessary to drive plural pixels on data signal lines aligned in a vertical direction on a screen. Thus, the matrix-type LCD has no such data signal output to drive single pixel alone, unlike a segment output of the segment display method. Therefore, although application of a driving method of the segment display method in the matrix-type LCD keeps the data signal lines and opposite electrode of the pixels at the high impedance state after electric charges are written in pixels on a bottom line on one picture (one picture in one frame), the pixels other than the pixels in a bottom line of the screen does not maintain an electric charge written therein, thereby failing to achieve a stable display on the matrix-type LCD.

Among such matrix-type LCDs, a matrix-type LCD using the simple multiplex driving method has a size of 2-inch and consumes electricity in a range of from 10 mW to 15 mW, which is sufficiently small. However, the matrix-type LCD of the simple multiplex driving method is disadvantaged in its low brightness and contrast and slow responding speed, which are fundamental display qualities. On the other hand, the matrix-type LCD employing the active driving method, in which the TFT or the like is used, is excellent in brightness and contrast, and has a fast responding speed, thereby being satisfactory in terms of the fundamental display qualities. However, even the matrix-type LCD of 2-inch size consumes electricity in a range of from 100 mW to 150 mW, which is unsatisfactorily high.

In view of the above problems, intensive research and developments have been carried out, aiming to attain sufficiently low electricity consumption and good display qualities. For example, Japanese Unexamined Utility Model Application, Jitsukaisho, No. 60-50573 (published on Apr. 9, 1985), and Japanese Unexamined Patent Application, Tokukaihei, No. 10-10489 (published on Jan. 16, 1998) disclose methods of achieving low electricity consumption. The methods in those publications, taking note of how television signals are transmitted, take advantage of the vertical blanking period, during which no data exists, so as to stop operation of a peripheral driving circuit during the vertical blanking period, thereby reducing the electricity consumption.

Moreover, another method is disclosed in Japanese Unexamined Patent Application, Tokukaihei, No. 9-107563 (published on Apr. 22, 1997), which relates to reduction of electricity consumption of a head mounting-type display apparatus for field sequential three-dimensional (3-D) image display, having two liquid crystal panels respectively for each eye. In this method, only one of the liquid crystal panels is driven during one field, while the other is stopped operating during the one field. In this way, the liquid crystal panels are driven in turn per field period.

As still another method, SID' 95 symposium digest, pages 249 to 252 (Titled: Multi-Field Driving Method For Reducing LCD Power Consumption) and Japanese Unexamined Patent Application, Tokukaihei, NO. 3-271795 (published on Dec. 3, 1991) discuss a multi-field driving method, in which scanning of one picture is carried out in such a manner that every other scanning signal line or every other several scanning signal lines are scanned so that scanning is performed in installment (that is, not at once, but divided into a plurality of times). In one time (one of the divided plurality of times) of the scanning, a voltage in the data signal line is not inverted (changed) in terms of polarity, thereby reducing electricity consumption of a data signal line driver. Moreover, this method also aims to realize a display free from flickering as a whole, by cancelling out flickering on one line with flickering on a neighboring line thereof. The flickering is changes of brightness caused between each line, and flickering on each line has an opposite polarity with respect to flickering on neighboring lines thereof.

Furthermore, for example, Japanese Unexamined Patent Application, Tokukaihei, No. 6-342148 (published on Dec. 13, 1994) discloses a method in which a ferroelectric liquid crystal is used in a liquid crystal panel so that the liquid crystal panel will function as a memory, so as to reduce a driving frequency (refresh rate), whereby the electricity consumption is lowered.

However, with the method in which the peripheral driving circuit is stopped operating during the vertical blanking period, the electricity consumption is reduced by about 5% only, because the vertical blanking period shares only about 8% of a whole period, as also recited in the above-mentioned Japanese Unexamined Utility Model, Jitsukaisho, No 60-50573.

Moreover, regarding the method disclosed in the above-mentioned Japanese Unexamined Patent Application, Tokukaihei, No. 9-107563, at least one of the liquid crystal panels is driven throughout all the field periods. As a result, the electricity consumption may not be increased but cannot be reduced with this method. Furthermore, in this method, an image with little flickering is attained when the display apparatus is of a both-eyed head-mounting type because at least one of the liquid crystal panels is refreshed. However, generally speaking, LCDs can attain display free from flickering when the LCDs are driven at not less than 30 Hz or especially 45 Hz or more. Therefore, application of this method in a liquid crystal panel to be viewed directly, the flickering becomes more perceptible.

Moreover, even if the multi-field driving method is employed, the flickering is caused on each line. Thus, even though the flickering is cancelled out between neighboring lines, the flickering does not become imperceptible in actuality, thereby deteriorating visibility significantly. Moreover, with this method, the reduction of the driving frequency is limited, so that the reduction of the electricity consumption is not satisfactory. Further, in the multi-field driving method, where the scanning of one picture screen is carried out in such a manner that every other scanning signal line or every other several scanning signal lines are scanned so that scanning is performed in installment, it is necessary to read a signal corresponding to the scanning signal line, which is currently being driven, after temporal storing of an image in a frame memory. As a result, it is inevitable that the multi-field driving method have a complicated circuit arrangement. Thus, it is a demerit of the multi-field driving method that the multi-field driving method requires a large peripheral circuit, resulting in a high cost.

Furthermore, in the above-mentioned method disclosed in Japanese Unexamined Patent Application, Tokukaihei, No. 6-342148, gradient display cannot be performed, because the ferroelectric liquid crystal basically carries out binary (black & white) display. Moreover, in order to make a liquid crystal panel of the ferroelectric liquid crystal, an advanced panelling technology is required. Therefore, application of this method is difficult and has not been put into practice until today.

As discussed above, none of the conventional driving methods for the matrix-type LCDs have achieved satisfactory and simple reduction of the electricity consumption with good fundamental display qualities, such as the brightness, contrast, response speed, and gradient. Furthermore, the conventional driving methods for the matrix-type LCDs cannot have satisfactory reduction of the electricity consumption and high display qualities. Those problems are not limited to LCDs, but common to any display apparatus of the matrix type.

SUMMARY OF THE INVENTION

The invention has an objective to offer a method, of driving a matrix display apparatus, which readily achieves sufficient reduction in electric consumption while satisfying basic display quality requirements including brightness, contrast, responding speed, and gradient, and also to offer a display apparatus to implement the method.

A method of driving a display apparatus in accordance with the invention, in order to achieve the above objective, is a method of driving a display apparatus including a screen which has pixels arranged in a matrix and producing a display by applying a scanning signal to scanning signal lines connected to the pixels and thus selecting a line to scan the screen and also by supplying a data signal to those pixels on the selected line via data signal lines and is characterized in that the method includes the step of providing, after scanning the screen twice or more, an idle period in which all the scanning signal lines are caused to be in a non-scanning state for a period longer than a time taken to scan the screen once.

According to the method, all the scanning signal lines are caused to be in a non-scanning state in the idle period, which reduces the number of times to rewrite the picture, that is, the output time of the data signal. Therefore, the provision of the idle period readily reduces the output time of the data signal, in other words, the electric consumption by a data signal line driver (source driver), or the electric power to charge the pixels, which increases in proportion to the supply frequency of the data signal, in, for example, an active-matrix-drive liquid crystal display.

Further, according to the method, by scanning the screen twice or more, writing can be carried out repeatedly until, for example, the response for display is completed; therefore, the response can be completed in a period shorter than a repetition interval composed of two or more scanning periods and an idle period.

More specifically, when a data signal is supplied to the pixels of the selected line via data signal lines, upon a change in the image to be displayed, a single rewrite of the picture falls short of applying a predetermined voltage to produce desired luminance to the pixel electrodes, and two or more rewrites are required to apply the predetermined voltage.

However, according to the method, by providing an idle period after the screen is scanned twice or more, a sufficient display responding speed is ensured even with the provision of the idle period, and basic display quality requirements are satisfied including brightness, contrast, responding speed, and gradient.

Therefore, by providing an idle period after scanning the screen twice or more, that is, after performing the scan to rewrite one picture twice or more, sufficient reduction in electric consumption can be readily achieved while ensuring a sufficient display responding speed and satisfying basic display quality requirements, such as brightness, contrast, responding speed, and gradient.

Another method of driving a display apparatus in accordance with the invention, in order to achieve the above objective, is a method of driving a display apparatus including a screen which has pixels arranged in a matrix and producing a display by applying a scanning signal to scanning signal lines connected to the pixels and thus selecting a line to scan the screen and also by supplying a data signal to those pixels on the selected line via data signal lines and is characterized in that the method includes the step of providing, when there is no change in an image to be displayed, an idle period in which all the scanning signal lines are caused to be in a non-scanning state for a period longer than a scanning period in which the screen is scanned once after the scanning period and when there has been a change in an image to be displayed, the idle period after the screen is scanned twice or more.

According to the method, by switching the drive of the display apparatus when there is no change in an image to be displayed and when there has been a change in an image to be displayed, optimum response and display quality as well as lower electric consumption, are achieved for every kind of display image including still pictures and dynamic pictures. For example, according to the method, all the scanning signal lines are caused to be in a non-scanning state in the idle period, which reduces the number of times to rewrite the picture, that is, the output time of the data signal. Therefore, the provision of the idle period readily reduces the output time of the data signal, in other words, the electric consumption by a data signal line driver (source driver), or the electric power to charge the pixels, which increases in proportion to the supply frequency of the data signal, in, for example, an active-matrix-drive liquid crystal display apparatus.

In this situation, when there is no change in an image to be displayed, an idle period in which all the scanning signal lines are caused to be in a non-scanning state for a period longer than a scanning period in which the screen is scanned once is provided after the scanning period. Thus, the electric power consumed in the rewriting of the picture can be reduced in the production of still pictures and other motionless displays (displays of non-animated images) and also dynamic pictures which include few motions, while satisfying basic display quality requirements, such as brightness, contrast, responding speed, and gradient.

Meanwhile, when there has been a change in an image to be displayed, by scanning the screen twice or more, writing can be carried out repeatedly until, for example, the response for display is completed; therefore, the response can be completed in a period shorter than a repetition interval composed of two or more scanning periods and an idle period.

As mentioned earlier, when a data signal is supplied to the pixels of the selected line via data signal lines, upon a change in the image to be displayed, a single rewrite of the picture falls short of applying a predetermined voltage to produce desired luminance to the pixel electrodes, and two or more rewrites are required to apply the predetermined voltage.

However, according to the method, by providing an idle period after the screen is scanned twice or more, a sufficient display responding speed is ensured even with the provision of the idle period, and basic display quality requirements are satisfied including brightness, contrast, responding speed, and gradient.

Therefore, the screen is scanned only once in a normal situation, that is, when there is no change in an image to be displayed, and the screen scan is repeated twice or more and only when the display is switched, that is, when there has been a change in an image to be displayed; thus, the number of times to rewrite the picture, that is, the output time of the data signal, can be further reduced and the electric consumption can also be further reduced, while ensuring a sufficient display responding speed and satisfy basic display quality requirements, such as brightness, contrast, responding speed, and gradient.

Another method of driving a display apparatus in accordance with the invention, in order to achieve the above objective, is a method of driving a display apparatus including a screen which has pixels arranged in a matrix and producing a display by applying a scanning signal to scanning signal lines connected to the pixels and thus selecting a line to scan the screen at a predetermined rewrite cycle and also by supplying a data signal to those pixels on the selected line via data signal lines and is characterized in that the method includes the step of scanning the screen at a rewrite cycle longer than the predetermined rewrite cycle when there is no change in an image to be displayed and at the predetermined rewrite cycle only when there has been a change in an image to be displayed.

According to the method, by switching the drive of the display apparatus when there is no change in an image to be displayed and when there has been a change in an image to be displayed, optimum response and display quality as well as lower electric consumption, are achieved for every kind of display image including still pictures and dynamic pictures. For example, according to the method, when there is no change in an image to be displayed, the number of times to rewrite the picture, that is, the output time of the data signal, can be further reduced by setting the rewrite cycle in scanning periods longer than usual, that is, longer than the predetermined rewrite cycle. Thus, the electric consumed in the rewriting of the picture can be reduced in the production of still pictures and other motionless displays (displays of non-animated images) and also dynamic pictures which include few motions, while ensuring basic display quality requirements including brightness, contrast, responding speed, and gradient.

Meanwhile, when there has been a change in an image to be displayed, by scanning the screen at a normal rewrite cycle, that is, the predetermined rewrite cycle, the display better follows changes in the image, and the image changes rapidly.

In this situation, in the foregoing method of driving a display apparatus, preferably, the screen is scanned twice or more at the predetermined rewrite cycle only when there has been a change in an image to be displayed.

A display apparatus in accordance with the invention, in order to achieve the above objective, is a display apparatus including a screen which has pixels arranged in a matrix and producing a display by applying a scanning signal to scanning signal lines connected to the pixels and thus selecting a line to scan the screen and also by supplying a data signal to those pixels on the selected line via data signal lines and is characterized in that the display apparatus includes a control section for controlling drive of the display apparatus, wherein the control section causes all the scanning signal lines to be in a non-scanning state for a period longer than a time taken to scan the screen once after the screen is scanned twice or more.

According to the arrangement, the control section causes all the scanning signal lines to be in a non-scanning state for a period longer than a time taken to scan the screen once after the screen is scanned twice or more, thereby reducing the number of times to rewrite the picture, that is, the output time of the data signal. Therefore, the output time of the data signal, in other words, the electric consumption by a data signal line driver (source driver), or the electric power to charge the pixels, which increases in proportion to the supply frequency of the data signal is readily reduced in, for example, an active-matrix-drive liquid crystal display apparatus.

Further, according to the arrangement, the control section scans the screen twice or more and thereafter causes all the scanning signal lines to be in a non-scanning state for a period longer than a time taken to scan the screen once. Thus, prior to causing all the scanning signal lines to be in a non-scanning state, writing can be carried out repeatedly until, for example, the response for display is completed; therefore, the response can be completed in a period shorter than a repetition interval composed of a period (scanning period) in which the screen is scanned twice or more and a period (idle period) in which all the scanning signal lines are caused to be in a non-scanning state for a period longer than a time taken to scan the screen once.

Therefore, according to the arrangement, a display apparatus can be offered with which sufficient reduction in electric consumption can be readily achieved while ensuring a sufficient display responding speed and satisfying basic display quality requirements, such as brightness, contrast, responding speed, and gradient.

A display apparatus in accordance with the invention, in order to achieve the above objective, is a display apparatus including a screen which has pixels arranged in a matrix and producing a display by applying a scanning signal to scanning signal lines connected to the pixels and thus selecting a line to scan the screen and also by supplying a data signal to those pixels on the selected line via data signal lines and is characterized in that the display apparatus includes a control section for controlling drive of the display apparatus; and a detection section for detecting a change in an image to be displayed, wherein according to a result of the detection by the detection section, the control section causes, when there is no change in an image to be displayed, all the scanning signal lines to be in a non-scanning state for a period longer than a time taken to scan the screen once after the screen is scanned once and, when there has been a change in an image to be displayed, all the scanning signal lines to be in a non-scanning state for a period longer than a time taken to scan the screen once after the screen is scanned twice or more.

According to the arrangement, the display apparatus includes the control section and the detection section, and the control section controls the drive of the display operation, that is, the display apparatus, switchably when there is no change in an image to be displayed and when there has been a change in an image to be displayed, according to a result of the detection by the detection section; therefore, electric power consumed in the rewriting of the picture can be reduced in the production of still pictures and other motionless displays (displays of non-animated images) and dynamic picture which include few motions, while satisfying basic display quality requirements, such as brightness, contrast, responding speed, and gradient.

Specifically, the number of times to rewrite the picture, that is, the output time of the data signal can be reduced by causing all the scanning signal lines to be in a non-scanning state for a period longer than a time taken to scan the screen once. Therefore, by causing all the scanning signal lines to be in a non-scanning state for a period longer than a time taken to scan the screen once, the output time of the data signal, in other words, the electric consumption by a data signal line driver (source driver), or the electric power to charge the pixels, which increases in proportion to the supply frequency of the data signal, can be readily reduced in, for example, an active-matrix-drive liquid crystal display apparatus.

However, when a data signal is supplied to the pixels of the selected line via data signal lines, upon a change in the image to be displayed, a single rewrite of the picture falls short of applying a predetermined voltage to produce desired luminance to the pixel electrodes, and two or more rewrites are required to apply the predetermined voltage:

Accordingly, in the arrangement, when there has been a change in an image to be displayed, by scanning the screen twice or more, writing can be carried out repeatedly until, for example, the response for display is completed; therefore, the response can be completed in a period shorter than a repetition interval composed of a period (scanning period) in which the screen is scanned twice or more and a period (idle period) in which all the scanning signal lines are caused to be in a non-scanning state for a period longer than a time taken to scan the screen once.

Therefore, according to the arrangement, a display apparatus is achieved which further reduces the number of times to rewrite the picture, that is, the output time of the data signal, and the electric consumption while ensuring a sufficient display responding speed and satisfying basic display quality requirements, such as brightness, contrast, responding speed, and gradient.

Another display apparatus in accordance with the invention, in order to achieve the above objective, is a display apparatus including a screen which has pixels arranged in a matrix and producing a display by applying a scanning signal to scanning signal lines connected to the pixels and thus selecting a line to scan the screen at a predetermined rewrite cycle and also by supplying a data signal to those pixels on the selected line via data signal lines and is characterized in that the display apparatus includes a control section for controlling drive of the display apparatus; and a detection section for detecting a change in an image to be displayed, wherein the control section controls application of the scanning signal to the scanning signal lines according to a result of the detection by the detection section so that the screen is scanned at a rewrite cycle longer than a predetermined rewrite cycle when there is no change in an image to be displayed and at the predetermined rewrite cycle only when there has been a change in an image to be displayed.

According to the arrangement, the display apparatus includes the control section and the detection section, and the control section controls the drive of the display operation, that is, the display apparatus, switchably when there is no change in an image to be displayed and when there has been a change in an image to be displayed, according to a result of the detection by the detection section; therefore, electric power consumed on the rewriting of the picture can be reduced in the production of still pictures and other motionless displays (displays of non-animated images) and dynamic picture which include few motions, while satisfying basic display quality requirements, such as brightness, contrast, responding speed, and gradient.

Specifically, the control section controls the application of the scanning signal to the scanning signal lines according to a result of the detection by the detection section so that the screen is scanned at a rewrite cycle longer than a predetermined rewrite cycle when there is no change in an image to be displayed and at the predetermined rewrite cycle only when there has been a change in an image to be displayed. Thereby, the number of times to rewrite the picture, that is, the output time of the data signal can be reduced when there is no change in an image to be displayed. Therefore, the output time of the data signal, in other words, the electric consumption by the data signal line driver (source driver), or the electric power to charge the pixels, which increases in proportion to the supply frequency of the data signal, can be readily reduced in, for example, an active-matrix-drive liquid crystal display apparatus.

Further, when there has been a change in an image to be displayed, by scanning the screen at a predetermined rewrite cycle, the display better follows changes in the image, and the image changes rapidly.

For a fuller understanding of the nature and advantages of the invention, reference should be made to the ensuing detailed description taken in conjunction with the accompanying drawings.

BRIEF DESCRIPTION OF THE DRAWINGS

FIG. 7(*b*) is a circuit diagram illustrating an equivalent circuit of a pixel section of the display apparatus in a black display state.

DESCRIPTION OF THE EMBODIMENTS

Described below is an embodiment of the present invention, with reference to FIGS. 1 to 14 and 18 to 21.

Note that, in the present embodiment, in order to explain a driving method of the present invention, discussed by way of example is a reflective active matrix-type LCD as a display apparatus to carry out the driving method. However, the present invention is not limited to this.

Figure 2:
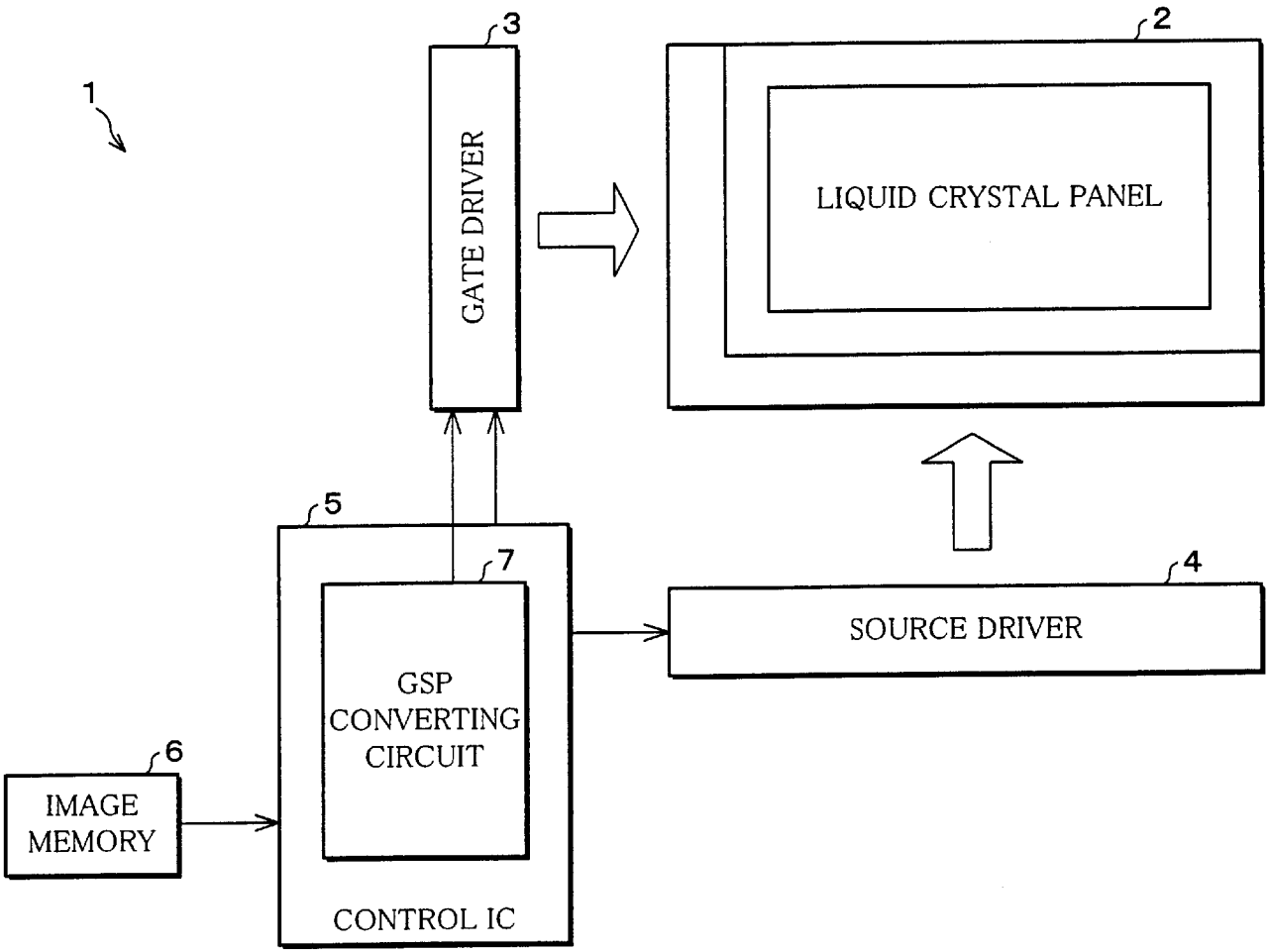
FIG. 2 is a system block diagram illustrating an arrangement of the display apparatus of the embodiment of the present invention.

As shown in FIG. 2, an LCD 1 as the display apparatus of the present embodiment is a reflective active matrix-type LCD, which is provided with a liquid crystal panel 2, a gate driver 3, a source driver 4, a control IC 5, and an image memory 6.

The liquid crystal panel 2 is provided with a screen, a plurality of scanning signal lines, and a plurality of data signal lines. The screen is composed of pixels arranged in matrix. The scanning signal lines perform selective scanning on the screen, selecting a line(s), so that the data signal lines supply data signals to pixels on the selected line. The scanning lines and the data signal lines cross each other at a right angle. The scanning signal lines scan the screen, selecting the lines in a line-by-line manner.

Figure 3:
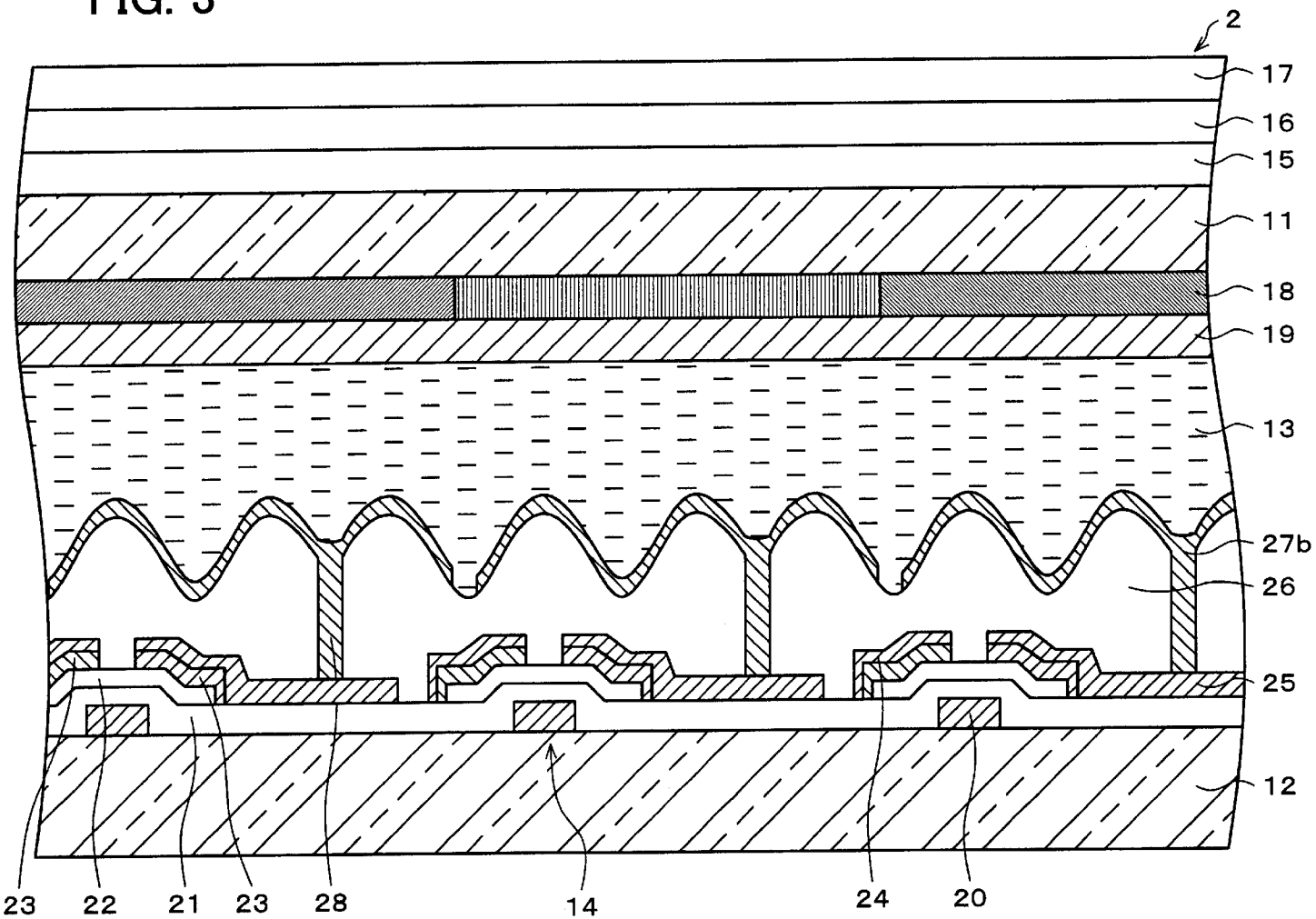
FIG. 3 is a cross sectional view of a liquid crystal panel of the display apparatus shown in FIG. 2.
Figure 4:
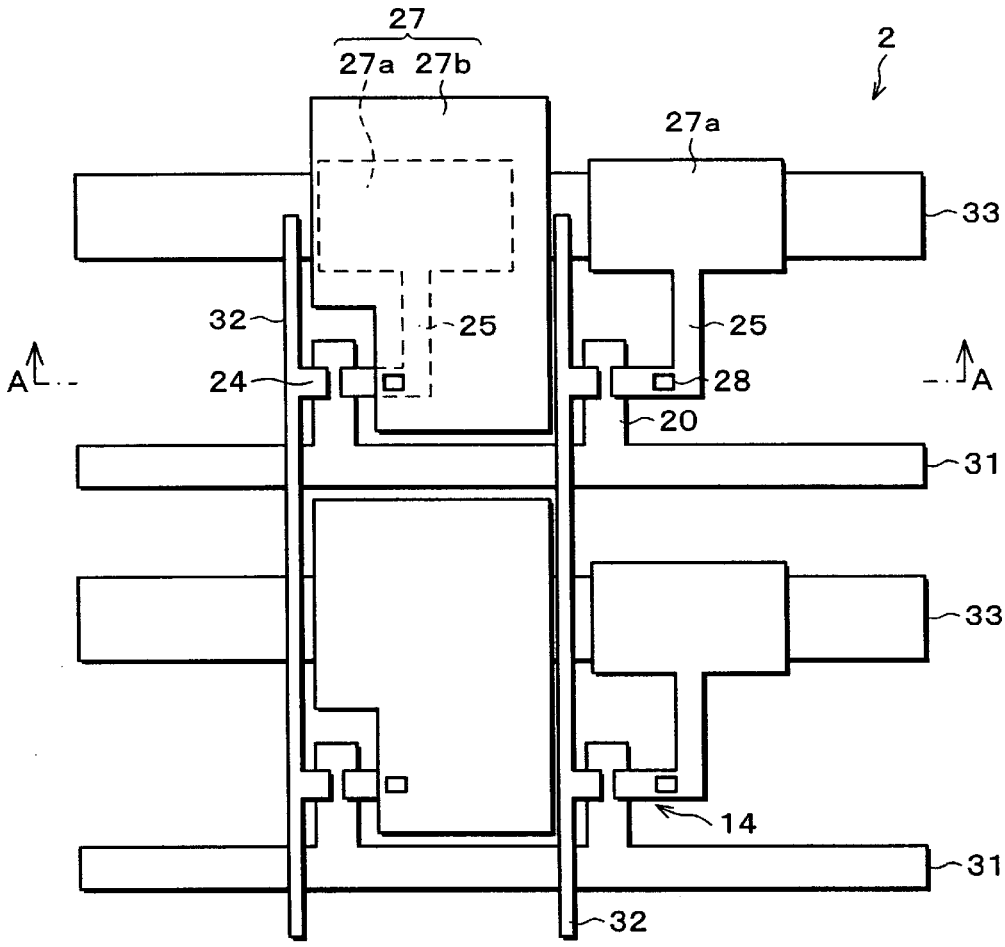
FIG. 4 is a plan perspective view illustrating the liquid crystal panel of the display apparatus shown in FIG. 2.

Here, referring to FIGS. 3 and 4, a specific arrangement example of the liquid crystal panel 2 is explained. In FIG. 3, shown is a sectional view of the liquid crystal panel 2. Note that FIG. 3 is taken on line A—A in FIG. 4, which is a plan perspective view illustrating an arrangement of the liquid crystal panel 2. Thus, FIG. 4 is a plan view showing an arrangement of a layer under a liquid crystal layer 13 shown in FIG. 3.

As shown in FIG. 3, the liquid crystal panel 2 is a reflective active matrix-type liquid crystal panel. The liquid crystal panel 2 has a fundamental structure in which the liquid crystal layer 13, which is for example made of a nematic liquid crystal, is sandwiched between two glass substrates 11 and 12, and TFTs 14, as active elements, are formed on the glass substrate 12. It should be noted that, although the TFT is used as the active element in the present embodiment, it is also possible to use for the active element an MIM (Metal Insulator Metal) or an FET (Field Effect Transistor) other than TFT. On a top surface of the glass substrate 11, provided are a phase differential plate 15, a polarizing plate 16, and an anti-reflection plate 17, in this order. On a bottom surface of the grass substrate 11, a color filter 18 for RGB, and a transparent common electrode 19, which acts as a counter electrode, are provided in this order. The color filter 18 enables the liquid crystal panel 2 to perform color display.

In each TFT 14, a scanning line 31 is formed on the glass substrate 12 (see FIG. 4) in such a matter that a part of the scanning line 31 acts as a gate electrode 20, and a gate insulating film 21 is formed on top of the gate electrode 20. Formed in a position that faces the gate electrode 20 is an i-type amorphous silicon layer 22, while sandwiching the gate insulating film 21. Formed respectively in two positions that sandwich a channel area of the i-type amorphous channel 22 are two $n^+$-type amorphous silicon layers 23. On one of the $n^+$-type amorphous silicon layers 23, provided is a data electrode 24, which is a part of the date signal line. A drain electrode 25 is formed by being drawn out from a top the other $n^+$-type amorphous silicon layers 23 to a flat top surface of the gate insulating film 21. As shown in FIG. 4, a position where the drawing out of the drain electrode 25 is started, and an end opposed to that position are connected to a support capacitance electrode pad 27*a*, which has a rectangular shape, and which opposes to a support capacitance line 33. On top of the TFTs 14, provided is an interlayer insulating 26. On top of the interlayer insulating 26, provided are reflection electrodes 27*b*. The reflection electrodes 27*b* are reflective section for performing reflection display by using peripheral light. In order to control a direction of reflection light from the reflection electrodes 27*b*, the interlayer insulating film 26 has fine projections and the recessions on a surface thereof.

Furthermore, each of the reflection electrodes 27*b* has continuity with the drain electrode 25 via a contact hole 28, which is provided to the interlayer insulating film 26. Specifically, a voltage applied from the data electrode 24 and controlled by the TFT 14 (one of the TFTs 14) is supplied from the drain electrode 25 to the reflection electrode 27*b*, via the contact hole 28, so that the liquid crystal layer 13 is driven by a voltage between the reflection electrode 27*b* and the transparent common electrode 19. In other words, there is continuity between the support capacitance electrode pad 27*a* and the reflection electrode 27*b*, while there is liquid crystals between the reflection electrode 27*b* and the transparent common electrode 19. In this manner, the support capacitance electrode pad 27*a* and the reflection electrode 27*b* form a pixel electrode 27. In case of LCDs of a transparent type, transparent electrodes arranged to correspond to the respective electrodes are such pixel electrodes.

Moreover, as shown in FIG. 4, the liquid panel 2 is provided, on the glass substrate 12, with scanning signal lines 31 and the data signal lines 32, in such a manner that the scanning signal lines 31 and the data signal lines 32 cross each other at a right angle. The scanning signal line 31 supplies a scanning signal to the gate electrode 20 of the TFT 14, while the data signal line 32 supplies a data signal to the data electrode 24 of the TFT 14. Moreover, the support capacitance lines 33 (a plurality of the support capacitance line 33) are provided as support capacitance electrodes, which provide support capacitance for the pixels, between the respective support capacitance electrode pads 27*a*. The support capacitance lines 33 are in parallel with the scanning signal lines 31 (that is, not crossing the scanning signal lines 31) on the glass substrate 12 so that some of the support capacitance lines 33 are in pairs with the support capacitance electrode pads 27*a*, sandwiching the gate insulating film 21. The provision of the support capacitance lines 33 is not limited to this arrangement, provided that the support capacitance lines 33 are so provided as not to cross the scanning signal lines 31. In addition, a part of the reflection electrode 27*b* is omitted in FIG. 4, in order to explicitly show a positional relationship between the support capacitance electrodes 27*a* and the support capacitance lines 33. Moreover, the projections and the recessions on the surface of the interlayer insulating film 26 shown in FIG. 3 are not illustrated in FIG. 4.

Moreover, as shown in FIG. 2, the gate driver 3, which is a scanning signal line driver, outputs a voltage to each scanning signal line of the liquid crystal panel 2. The voltage is in accordance with whether the scanning signal line is in a selected period (during which the scanning signal line is selected) or in a non-selected period (during which the scanning signal line is not selected). The source driver 4, which is a data signal line driver, outputs the data signal to each data signal line 32 of the liquid crystal panel 2, so as to supply an image data to each pixel located on the scanning signal line 31 that is selected.

The control IC 5 receives an image data stored in the image memory 6, which is located inside a PC or the like, and transmits to the gate driver 3, a gate starting pulse signal GSP and a gate clock signal GCK, while the control IC 5 transmits to the source driver 4 a gradient data of RGB, a source starting pulse signal SP, a source latch strobing signal SLS, and a source clock signal SCK. All of those signals synchronize to each other. The image data stored in the image memory 6, which is image data storing means, is a data on which the data signal is based. Moreover, the control IC 5 acts as control means (control section) for performing a driving method of the display apparatus of the present embodiment, which is explained hereinafter.

The gate driver 3 starts scanning the liquid crystal panel 2 upon receipt of the gate starting pulse signal GSP from the control IC 5, and supplies sequential selecting voltage to each scanning signal line in accordance with the gate clock signal GCK. In accordance with the source starting pulse signal SP received from the control IC 5, the source driver 4 stores in a register each received gradient data respectively for each pixel. Then, the source driver 4 writes the gradient data in each data signal line of the liquid crystal panel 2 in accordance with a next source latch strobing signal.

Moreover, the control IC 5 is provided, inside thereof, with a GSP converting circuit 7, which sets a pulse interval of the gate start pulse signal GSP. The pulse interval of the gate start pulse signal GSP is about 16.7 msec when a frame frequency of display is 60 Hz as usual. The GSP converting circuit 7 can extend the pulse interval of the gate starting pulse signal GSP to 167 msec, for example.

Here, about 9/10 (nine out of ten) of the pulse interval, excluding a scanning period T1, is a non-scanning period, when all the scanning signal line is not scanned, where the scanning period T1 is a period in which scanning of the screen is completed once, and where the scanning period T1 have a usual length, that is, about 16.7 msec.

The scanning period T1 and the non-scanning period can be set arbitrarily according to how much an image, such as still pictures or dynamic pictures, to be displayed is moved, while a plurality of the non-scanning period can be provided in accordance with content of the image to be displayed. In order words, the GSP converting circuit 7 carries out the setting of the pulse interval by arbitrarily setting the scanning period and the non-scanning period.

In addition, for example, the control IC 5 may be provided, inside thereof, with a detection circuit (detection section) for detecting whether or not there is a change in the image data, which is transmitted from the image memory 6 with an interval, or whether the image data is changed as a still picture, so that the setting of the non-scanning period will be changed in accordance with the image data. Moreover, the setting of the non-scanning period may be changed in accordance with a plurality of non-scanning period setting signal externally inputted into the GSP converting circuit 7. Moreover, the GSP converting circuit 7 may be provided with a control dial, a selection switch or the like for adjusting the non-scanning period. Of course, such control dial, a selection switch, or the like may be provided to an exterior of a box body of the liquid crystal display apparatus 1, so that the user can set the non-scanning period with ease. Moreover, although illustrated in FIG. 2 is an arrangement where the GSP converting circuit 7 is incorporated inside the control IC 5, the present invention is not limited to this arrangement, and the GSP converting circuit 7 may be provided independently from the control IC 5.

As discussed above, the GSP converting circuit 7 can convert the scanning period and the non-scanning period. Thus, as exemplified above, the GSP converting GSP 7 can set the non-scanning period, which is between completion of the scanning period T1 and the input of another gate starting pulse signal GSP into the gate driver 3, to be longer than the scanning period T1. The non-scanning period that is longer than the scanning period T1 is designated as an idle period T2, hereinafter.

Figure 5:
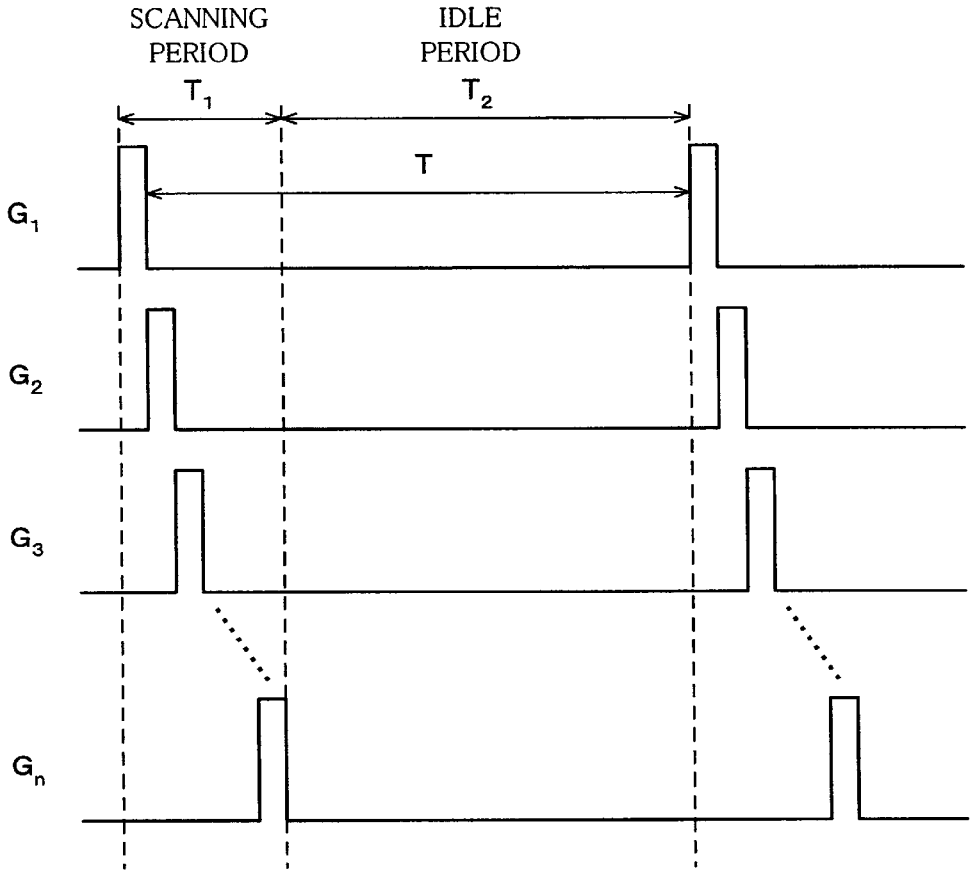
FIG. 5 is a timing chart explaining how the display apparatus is driven when a scanning period and an idle period are repeated in turn per Et vertical cycle.
Figure 16:
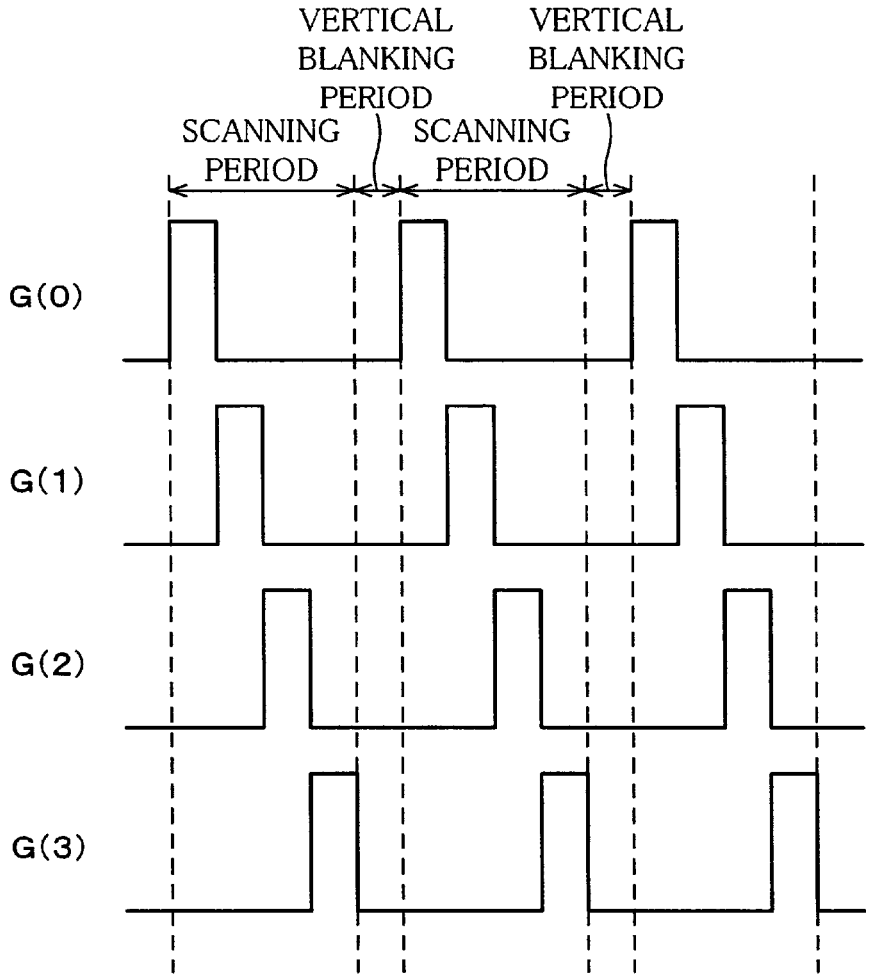
FIG. 16 is a timing chart explaining how a conventional display apparatus is driven.
Figure 17:
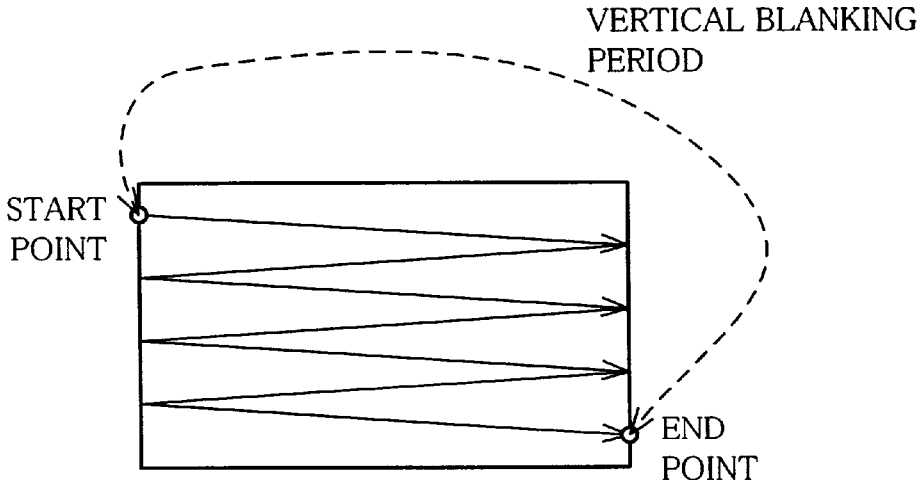
FIG. 17 is an explanatory view explaining a vertical blanking period.

Here, for sake of comparison, illustrated in FIG. 5 is a wave form of scanning signals supplied into scanning lines G1 to Gn, where an idle period T2 is set as the non-scanning period with respect to a scanning period T1 having a usual length in one picture. In FIG. 5, where n=4, the idle period T2 is the non-scanning period, compared with wave forms of conventional scanning signals shown in FIG. 16 where a vertical blanking period is the non-scanning period. In this manner, a vertical cycle, which indicates a frame or a field, is longer in FIG. 5, compared with the conventional case shown in FIG. 16. If the GSP converting circuit 7 sets the idle period T2 as the non-scanning period, one vertical cycle is a sum of the scanning period T1 and the idle period T2. The GSP converting circuit 7 can set a plurality of the non-scanning periods (scanning period T) in accordance with content of the image, as discussed above. At least one of the non-scanning periods (scanning period T) is the idle period T2 in the present embodiment.

The provision of the idle period T2 in this manner reduces a number of times to rewrite the picture, that is, a supply frequency of the data signal outputted from the source driver 4, thereby reducing an electricity to charge the pixel. Therefore, in case that the LCD 1 is an active matrix-type LCD in which fundamental qualities such as brightness, contrast, a responding speed, and a degree of gradient, are ensured, the setting the idle period T2 as the non-scanning period can reduce electricity consumption of a data signal line driver without spoiling the display qualities. Otherwise, the electricity consumption of the data signal line driver is proportionally increased in accordance with the supply frequency of the data signal.

Therefore, in case of displaying an image having no movement, such as the still picture, or dynamic picture in which an image is hardly moved, the electricity consumption for rewriting the picture can be reduced by setting the non-scanning period to the long idle period T2, while keeping the fundamental display qualities.

However, as shown in FIG. 5, a period of rewriting the picture becomes longer, when the scanning period T1 and the idle period T2, during which all the scanning signal lines 31 are in a non-scanning state (that is, all the scanning signal lines 31 are not subjected to the scanning), and which is longer than the scanning period T1, are repeated every vertical cycle. When the display is switched over, for example in case of the liquid crystal, which has a slow responding speed and a capacitance varied depending on a voltage applied therein, in case of the dynamic picture, in which an image is varied always, or in case the still picture is switched over to the dynamic image, this causes such a problem that the responding speed of the display is slowed down more than the period of rewriting the picture, thereby deteriorating the display qualities.

Therefore, discussed below is a driving method of the display apparatus free from such problem, explaining, by way of example, a case where the display on the LCD 1 of the liquid crystal panel 2 is switched over from a white display to the black display.

Figure 7:
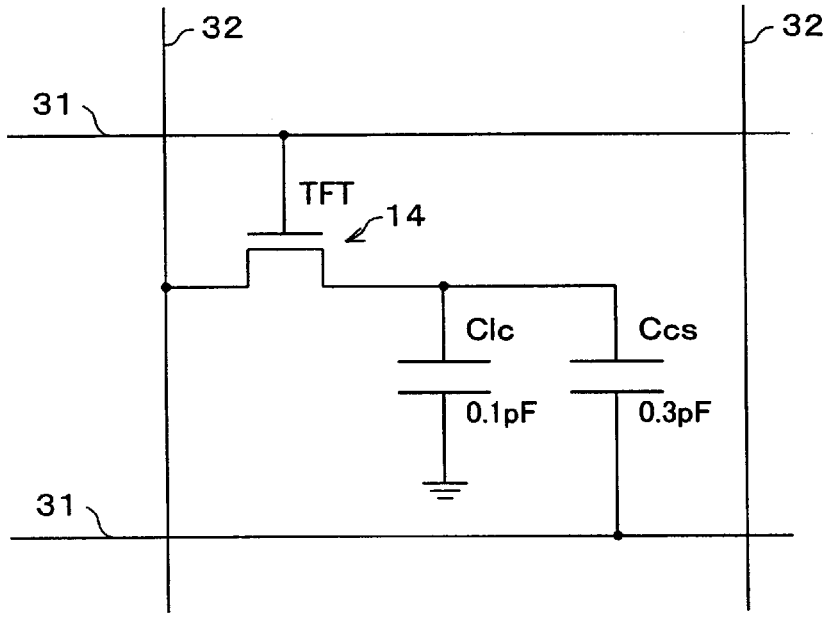
FIG. 7(*a*) is a circuit diagram illustrating an equivalent circuit of a pixel section of the display apparatus in a white display state.
Figure 7:
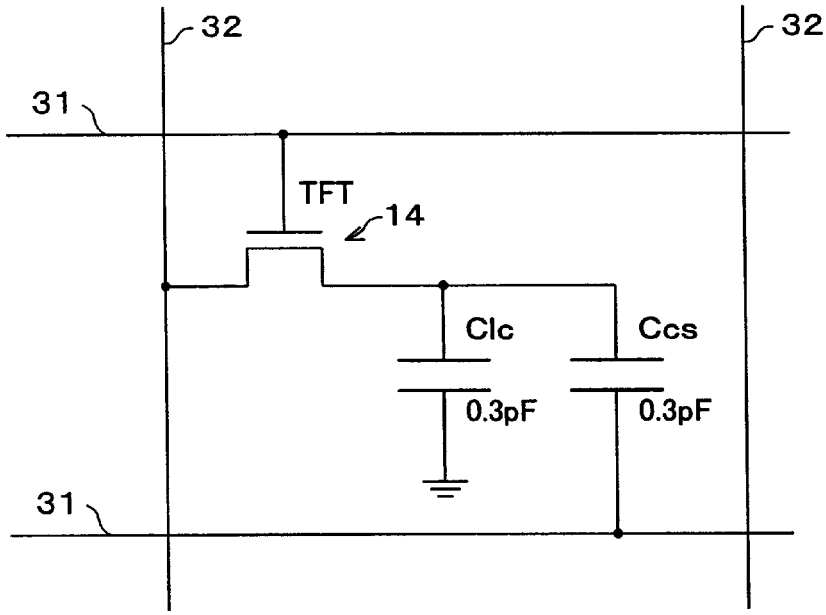

FIGS. 7(*a*) and 7(*b*) are circuit diagrams illustrating an equivalent circuit of a single pixel (pixel section) of the liquid crystal panel 2 of the LCD 1. Display of the liquid panel 2 is varied by a change in a liquid crystal capacitance (Capacitance of Liquid Crystal) CLC. Here, FIG. 7(*a*) shows the equivalent circuit when the liquid crystal panel 2 has the white display, while FIG. 7(*b*) illustrates the equivalent circuit when the liquid crystal panel 2 has the black display.

In case the liquid crystal panel 2 changes its display, for example from the white display to the black display as shown in FIGS. 7(*a*) and 7(*b*), to begin with, the selective voltage is applied into the scanning signal line 31 during a first scanning period T1, so as to turn ON the TFT 14. This applies a voltage for the black display from the data signal line 32 to the liquid crystal CLC and a support capacitance (Capacitance of Capacitance Support) CCS. In this time, an initial capacitance (for example, 0.1 pF) of the liquid crystal capacitance CLC varied, in accordance with the applied voltage.

Next, a non-selection voltage is applied into the scanning signal line 31, so as to turn OFF the TFT 14 in order to keep the liquid crystal capacitance CLC and the support capacitance CCS. However, the liquid crystal has such slow responding speed that it takes several ten msec to complete the change of the liquid crystal capacitance CLC. Moreover, the liquid crystal capacitance CLC is varied in accordance with the voltage applied therein. Because of this, the liquid crystal capacitance CLC is varied in a slow speed even after the TFT 14 is turned OFF.

Figure 1:
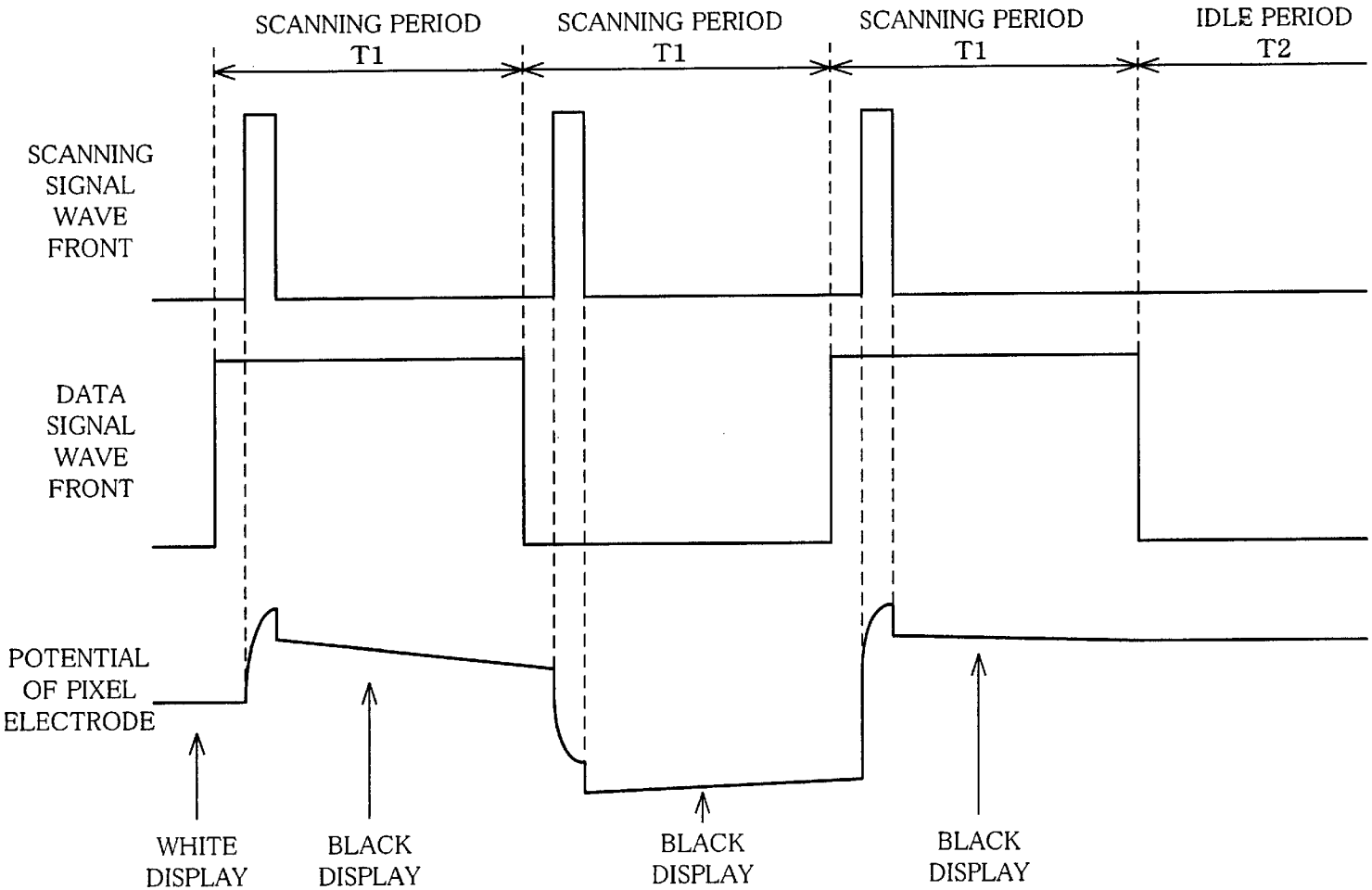
FIG. 1 is a timing chart explaining how a display apparatus of an embodiment of the present invention is driven after a driving method.
Figure 6:
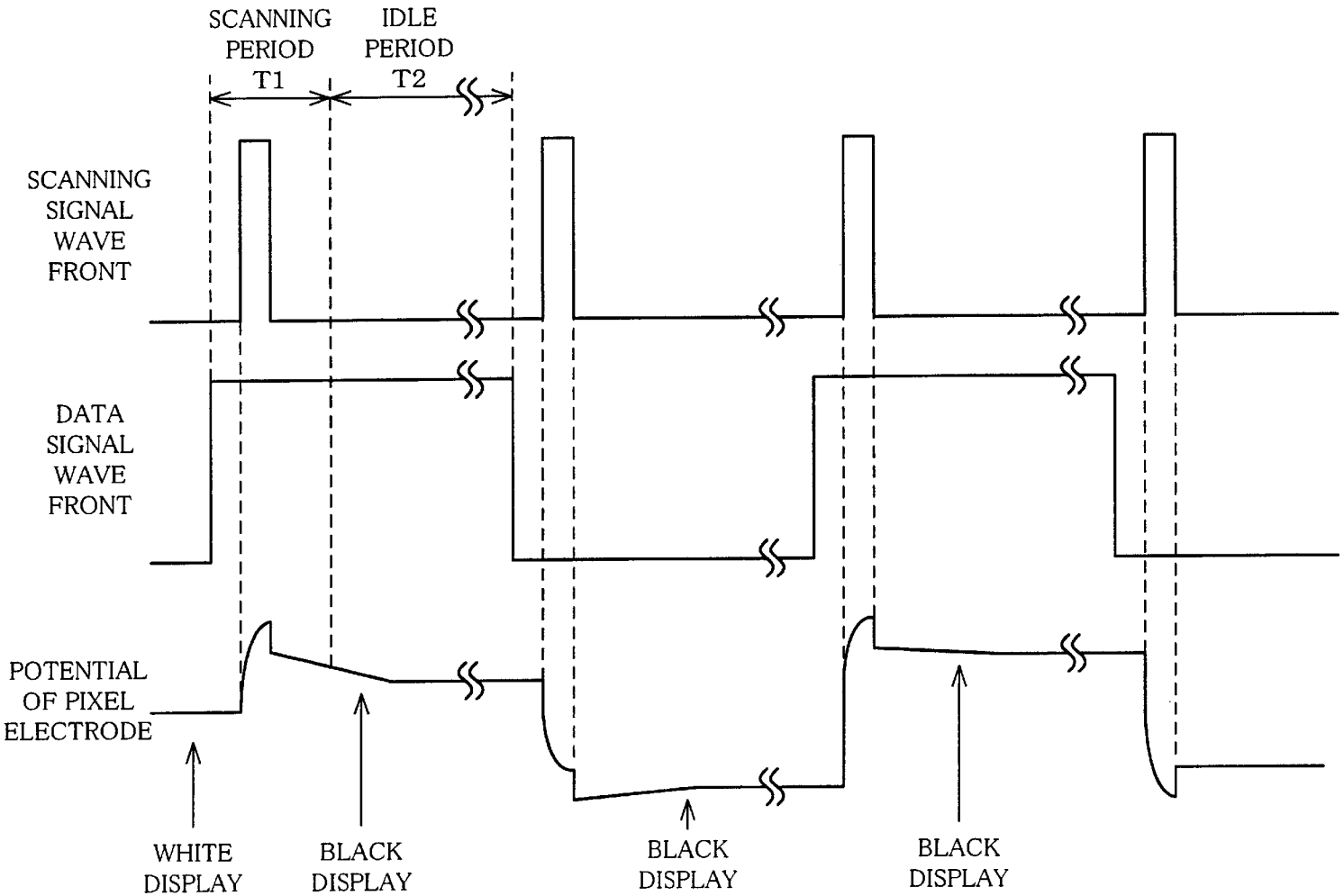
FIG. 6 is another timing chart explaining how the display apparatus is driven when a scanning period and an idle period are repeated in turn per a vertical cycle.

When the capacitance of the liquid crystal capacitance CLC is varied in this manner while the TFT 14 is in an OFF state, a potential of the pixel electrode 27 is changed as much as the capacitance changed after the TFT 14 is turned OFF as shown in FIGS. 1 and 6. Therefore, during the first rewriting, the potential of the pixel electrode 27 is not applied until a voltage applied into the pixel electrode 27 reaches a predetermined voltage.

More specifically, an ON state of the TFT 14 causes a relationship Q=CV, where Q is an electric charge Q to be charged by one time of turning ON, C is a capacitance, and V is a voltage. Because of this, as shown in FIG. 7(*b*), when the capacitance C, that is, the capacitance of the liquid crystal capacitance CLC becomes larger, the voltage V applied on the liquid crystal becomes smaller, because the electric charge is kept to be constant. Because of this, a desired luminance to perform display cannot be achieved.

Thereafter, during a second scanning period T1, a voltage for the black display is applied into the liquid crystal capacitance CLC and the support capacitance CCS from the data signal line 32, similarly. As a result, the liquid crystal capacitance CLC is changed. However, during the second scanning period T1, an amount of the change of the liquid crystal capacitance CLC is less, because the liquid crystal capacitance CLC has already been changed to some extent. Therefore, the potential of the pixel electrode 27 changed by a small amount after the TFT 14 is turned OFF.

During a third scanning period T1, because the change of the liquid crystal capacitance CLC is almost completed, a change of the potential of the pixel electrode 27 after the TFT 14 is turned OFF is quite small. In this time, the predetermined voltage is applied so that the display apparatus can perform a predetermined display.

Where the display is switched over in the above manner, at the first rewriting of the picture, the voltage applied into the pixel electrode 27 does not yet reach up to the predetermined voltage for achieving the desired luminance for the display satisfactory in the fundamental qualities, such as the brightness, contract, responding speed, and gradient. Therefore, the rewriting needs to be repeated plural times until the received voltage reaches the predetermined voltage. Usually, when the rewriting is repeated about three times, the predetermined voltage (for example, 0.3 pF) is reached and the predetermined display (in this case, the black display) is performed.

For example, if the rewriting cycle of the picture is 60 Hz, and if the three-time rewriting attains the predetermined voltage, continuous (successive) rewriting achieves the predetermined voltage within about 50 msec. However, in case the scanning period T1 and the idle period T2 are repeated every vertical cycle, as shown in FIG. 6, in order to reduce the electricity consumption, while having the rewriting cycle of the picture extended, for example, to 6 Hz, which is 1/10 of 60 Hz, it would take about 500 msec before the predetermined voltage is reached. This makes the responding speed of the display slower than the rewriting cycle of the picture, thereby deteriorating the display qualities.

Therefore, in the driving method of the present embodiment, the idle period T2 is provided after the scanning period T1 is provided twice or more as shown in FIG. 1. The control IC 5 is used to control to provide the scanning period T1 and the idle period T2. For example, it is so set that the scanning period T1 is successively repeated three times, while it is so set by the GSP converting circuit 7 that one scanning takes a time equivalent to 60 Hz as usual. With the driving method, where the idle time is longer than 60 Hz, the scanning periods T1 and the idle period T2 are repeated in a repeating interval of a frequency lower than 15 Hz. In this case, with the driving method, the pixel electrode 27 receives the predetermined voltage within about 50 msec, because the scanning is carried out continuously three times. Therefore, it is possible that the liquid crystal responses in a shorter time than the repeating interval of the plural scanning periods T1 and the idle period T2, which is provided right after the scanning periods T1 are provided (the scanning period T1 is provided twice or more).

When the LCD is used as a display apparatus in this manner, no vertical blanking period is needed. Therefore, it is possible to carry out the scanning continuously (successively) plural times (twice or more). A short non-scanning period may be provided between the respective scanning periods T1, besides the vertical blanking period. However, for display apparatuses in which the scanning periods T1 can be provided successively (the scanning period T1 is provided two or more successive times) to ensure a responding speed for a sufficient display, it is preferable that a plurality of the scanning periods T1 are provided continuously (that is, without the non-scanning period between the scanning periods T).

In addition, a number of times of inputting of the gate starting pulse signal GSP (which corresponds to the scanning period T1), that is, a number of times of the repeating of the scanning period T1 may be arbitrarily repeated in accordance with a responding performance of a liquid crystal material to be used, and a size of the support capacitance CCS. If the liquid crystal material to be used has a fast responding performance, it may be so set that a number of times of the pulse intervals is small. Meanwhile, it may be so set that the number of times of the pulse intervals is large, if the liquid crystal material to be used has a slow responding performance. Moreover, in case the liquid crystal material to be used has the slow responding performance, a short idle period T2 or a suspension period may be provided between the respective scanning period T1. The suspension period will be discussed later.

It is appropriate that number of times of the pulse intervals of the gate starting pulse signal GSP, which corresponds to the scanning period T1, be set so that the voltage applied into the pixel electrode 27 reaches the predetermined voltage so as to achieve the desired luminance for the display satisfactory in the fundamental qualities such as the brightness, contrast, responding speed and gradient.

As discussed above, with the driving method, where the display apparatus carries out the scanning the screen in plural times, it is possible to repeat rewriting, for example, until the response of the display is completed. Because of this, the response can be completed in a shorter time than the repeating interval which includes the plural scanning periods T1 and the idle period T2 therein.

Therefore, with the above driving method, where provided after the plural scanning periods T1 is the idle period T2, during which all the scanning signal lines 31 are not subjected to the scanning in a period longer than a period of time to be taken for scanning the screen one time, it is possible to ensure a sufficient responding speed of the display, while having the satisfactory fundamental qualities, such as the brightness, contrast, responding speed, and gradient, even though the idle period T2 is provided.

Moreover, with the driving method, the provision of the idle period T2 reduces the number of times to rewrite the screen, that is, shortens a time during which the data signal is outputted. This easily reduces the time during which the data signal is outputted, in other words, electricity consumption of the source driver 4, that is, electricity to charge the pixels. The source driver 4 is the data signal line driver and the electricity consumption of the source driver 4 is proportionally increased with the supply frequency of the data signal.

Because of this, the provision of the idle period after the screen is scanned in plural times, that is, after the scanning to rewrite one picture is repeated in plural times, makes it possible to reduce the electricity consumption easily and sufficiently while having the sufficient responding speed of the display and the satisfactory display qualities, such as the brightness, contrast, responding speed and gradient.

As described above, the pulse interval of the gate starting pulse signal GSP, which corresponds to the scanning period T1, is about 16.7 msec when the frame frequency of the display is 60 Hz as usual. For example, where the GSP converting circuit 7, successively and repeatedly, outputs the gate starting pulse signal GSP three times with the pulse interval of about 16.7 msec, and where 167 msec is a repeating interval between the three-time outputs of the gate starting pulse signal GSP and the idle period T2, the GSP converting circuit 7 is able to set about 7/10 (seven out of ten) of the repeating interval as the idle period T2, during which all the scanning signal lines 31 are in the non-scanning state.

As discussed above, the GSP converting circuit 7 can provide the idle period T2 within the non-scanning period, after the scanning periods T1 is repeated in plural times. In FIG. 1, a scanning signal wave form of this case is illustrated.

The scanning period T1 and the non-scanning period may be arbitrarily set in accordance with an amount of movement of the image to be displayed, such as the still picture or the dynamic picture. The GSP converting circuit 7 is capable to setting a plurality of the non-scanning periods in accordance with content of the image. In addition, at least one of the non-scanning period is the idle period T2.

Moreover, in the present embodiment, the provision of the idle period T2 is enough to reduce the electricity consumption, because no scanning is performed during the idle period T2. However, it is possible to further reduce the electricity consumption by providing the suspension period within the idle period T2. During the suspension period, a circuit, (such as an analogue circuit of the source driver 4) not related to (unnecessary for) the display is stopped operating. Note that, the provision of the suspension period within the idle period T2 indicates that all or part of the idle period T2 is set as the suspension period. In other words, if it is in the suspension period, it should be in the idle period.

More specifically, the gate driver 3 and the source driver 4 are respectively provided with a logic circuit therein. Each of the logic circuits consumes the electricity to operate a transistor located inside each logic circuit. Electricity consumption of the logic circuits is proportional to a number of times of the operation of the transistors, and proportional to the clock frequency. In the present embodiment, because all the scanning signal lines 31 are in the non-scanning state during the idle period T2, no signal other than the gate starting pulse signal GSP, such as a gate clock signal GCK, a source starting pulse signal SP, a source clock signal SCK, is not inputted the gate driver 3 and the source driver 4. In this way, eliminated is a need to operate the logic circuits inside the gate driver 3 and the source driver 4, thereby reducing the electricity consumption.

Moreover, in case the source driver 4 is a digital driver for dealing with a digital data signal, the source driver 4 is provided, inside thereof, with analogue circuits, such as a gradient generating circuit and a buffer. In the analogue circuit, a current flows always. Moreover, if the source driver 4 is an analogue driver for dealing with an analogue data signal, the source driver 4 is provided with analogue circuits, namely a sampling hold circuit and a buffer. Further, there is a case the control IC 5 is provided with such analogue circuits inside thereof.

Electricity consumption of the analogue circuits does not depend on a driving frequency. Therefore, the consumption electricity of the whole apparatus cannot be reduced by stopping the operation of the logic circuits inside the gate driver 3 and the source driver 4. If the analogue circuits are stopped (suspended) during the idle period T2, supply of electricity to the analogue circuit is cut off, thereby reducing the electricity consumption of the analogue circuit, thus further reducing the electricity consumption of the whole LCD 1. In addition, if the LCD 1 is an active matrix-type LCD, non-selection voltage is applied from the gate driver 3 into the pixels during the idle period T2. Therefore, the analogue circuits to be stopped are the analogue circuits at least irrelevant (not relating) to the gate driver 3, in other words, irrelevant to display performed during the idle period T2. When at least the analogue circuit of the source driver 4 is stopped, which has the largest electricity consumption among the analogue circuits, it is possible to efficiently reduce the electricity consumption of the whole electricity consumption.

Moreover, because no data is written in the pixels during the idle period T2, electricity consumed for transmitting the image data during the idle period T2 can be reduced by stopping the transmission of the image data from the image memory 6 during the idle period T2. In order to stop the transmission of the image data, the control IC 5 requests the image memory 6 to stop transmitting the image data, for example, in accordance with non-scanning period setting signal or the like, which is externally inputted into the GSP converting circuit 7, as discussed above. This further reduces the electricity consumption of the whole LCD 1, even though control of stopping the transmission is easy.

Furthermore, there is a case where image data supplying means, with which the LCD 1 is external supplied the image data. In this case, the image memory 6 may or may not be provided inside the LCD 1. In this case, it is possible that the LCD 1 stops operating to receive the image data supplied from the image data supplying means during the idle period T2. For example, when an input section of the control IC 5 has a higher impedance than a section supplying the image data in accordance with the non-scanning period setting signal, reduced is electricity consumed for receiving the image data supplied during the idle period T2 by using the LCD 1 to stop the operation to receive the image data supplied from the image data supplying means during the idle period T2. Therefore, the electricity consumption of the whole LCD 1 is further reduced.

Next, described is a method how to achieve high display qualities while flickering of the screen is sufficiently suppressed, in case the idle period T2 is provided.

Firstly, all the data signal lines 32 are caused to have a higher impedance than the source driver 4, for example, by disconnecting the data signal lines 32 from the source driver 4. This maintains a potential of each of the data signal lines 32 constant, thereby suppressing a change in a data storing state of each pixel due to a change in the potential of the data signal lines 32, and thereby sufficiently suppressing the flickering. Because of this, electricity consumption is sufficiently reduced and high display qualities are achieved while the flickering is sufficiently suppressed. An example of the change in the data storing state of each pixel is a change in a potential of the pixel electrodes 27 due to combination of capacitances of the data signal lines 32 and the pixel electrodes 27, which is caused in case the LCD 1 is provided with the pixel electrodes 27, which are connected with the data signal lines 32.

Moreover, in case the analogue circuits inside the buffer of the source driver 4 are stopped operating for reduction of the electricity consumption as discussed above, the buffer attains a ground potential. As a result, the data signal lines 32 connected to the buffer attains simultaneously a ground potential. This causes that the potential of the pixel electrode 27 is changed due to the combination of the capacitances when the LCD 1 is provided with the pixel electrode 27 to be connected with the data signal lines 32. In order to avoid this, the operation of the analogue circuits irrelevant to the display during the idle period T2 is stopped after all the data signal lines 32 attain the higher impedance. This makes it possible to suppress the change in the data storing state of the pixels while reducing the electricity consumption of the analogue circuits, whereby the high display qualities are attained with further reduced flickering.

Furthermore, it is more preferable that all the data signal lines 32 attain the higher impedance after all the signal lines 32 attain such a potential with which the change of the data storing state of all the pixels is substantially minimum on average. For example, where the LCD 1 had a structure in which a liquid crystal is located between the pixel electrodes 27 connected to the data signal lines 32 and opposite electrodes thereof, when an A.D. voltage is applied into the opposite electrode, all the data signal lines 32 are given a potential equivalent to a center of an amplitude of the A.D. voltage, while all the data signal lines 32 attain a potential equivalent to that of the opposite electrode. In this case, even if A.D. driving causes coexistence of the pixels of positive potential and the pixel electrodes 27 of negative potential, substantially minimized on average is a change in charge storing state of all the pixels due to the capacitance combination of the data signal lines 32 and the pixel electrodes 27, that is, the change in the data storing state. This makes it possible to attain the high display qualities with further reduced flickering because the change in data storing state is substantially minimized with respect to the whole picture, even if the each line has a different data storing state of the pixels.

As described in the foregoing, a method of driving a display apparatus in accordance with the present invention is a method of driving a display apparatus including a screen which has pixels arranged in a matrix and producing a display by applying a scanning signal to scanning signal lines connected to the pixels a line at a time and thus selecting a line to scan the screen sequentially, for example, and also by supplying a data signal to those pixels on the selected line via data signal lines, wherein the method includes the step of providing, after scanning the screen twice or more, an idle period in which all the scanning signal lines are caused to be in a non-scanning state for a period longer than a time taken to scan the screen once.

As described in the foregoing, a display apparatus in accordance with the present invention is a display apparatus including a screen which has pixels arranged in a matrix and producing a display by applying a scanning signal to scanning signal lines connected to the pixels a line at a time and thus selecting a line to scan the screen sequentially, for example, and also by supplying a data signal to those pixels on the selected line via data signal lines, and includes control means for controlling drive of the display apparatus, wherein the control means causes all the scanning signal lines to be in a non-scanning state for a period longer than a time taken to scan the screen once after the screen is scanned twice or more.

With the present embodiment, therefore, it is possible to sufficiently lower electricity consumption with ease while the sufficient responding speed of the display is ensured, and to have the satisfactory fundamental display qualities, such as the brightness, contrast, responding speed, and gradient.

Especially, in case of a display apparatus requiring no vertical blanking period, such as a case in which an LCD is used as the display apparatus, it is possible to carry out the scanning successively twice or more. Hence, it is preferable, for a display apparatus capable of providing the scanning periods T1 successively, to provide a plurality of the scanning periods T1 successively, in order to ensure the sufficient responding speed of the display, even though it is also possible to provide a short non-scanning period.

Therefore, for the driving method of the display apparatus, it is preferable to provide the idle period T2 after the scanning period T1, during which the screen is scanned once, is successively provided twice or more.

Regarding the display apparatus, it is preferable that the control means put all the scanning signal lines in the non-scanning state for a duration longer than the scanning period T1 during which the screen is scanned once.

Figure 18:
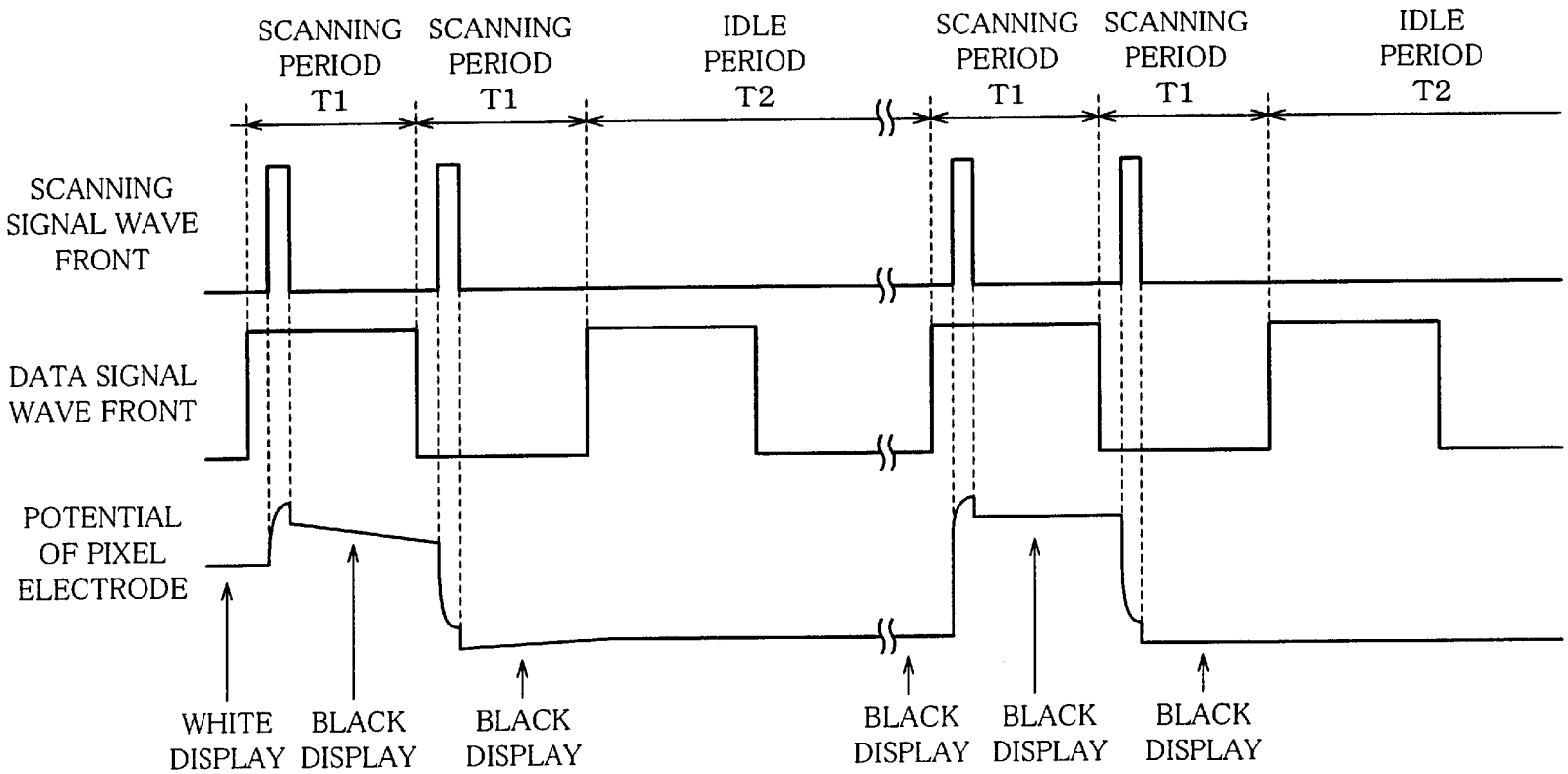
FIG. 18 is a timing chart explaining how the display apparatus actuated by A.C. driving is driven in case a scanning period in provided in an even number of times, where repeated is a step, in which the scanning period is provided in twice or more and followed by the idle period.

However, as shown in FIG. 18, regarding display apparatuses actuated by A.D. driving, such as LCDs, if the scanning is carried out in an even number of times, a positive voltage for the black display is applied into the liquid crystal during the first scanning period T1, and a negative voltage is applied into the liquid crystal during the second scanning period T1. Thus, the polarity is changed from one scanning period T1 to next. The negative polarity is remained in the idle period T2, following the scanning period. T1. Then, in the scanning period T1 firstly provided after the idle period T2, (that is the scanning period T1 immediately after the idle period T2), the positive voltage is applied, while the negative voltage is applied during the second scanning period T1. Similarly, the polarity is changed from one scanning period T1 to next. Therefore, the display apparatus has the negative voltage always during the idle period T2. As a result, a direct current is applied into the liquid crystal, thereby deteriorating reliability of the liquid crystal and the display qualities.

As discussed above, in case the display apparatus used is a display apparatus suitable for A.D. driving and actuated by A.D. driving, the direct current is applied into the display apparatus, when a polarity of potential difference between two electrodes, that is, the pixel electrode and the opposite electrode of each pixel is constant always during the idle period T2. In case of the LCD shown in FIGS. 3 and 4, the polarity of the potential difference is a polarity of potential difference between the pixel electrode 27 and the transparent common electrode 19 as the opposite electrode, where the pixel electrode 27 drives the liquid crystal layer 13 by applying the voltage into the liquid crystal layer 13. The applying of the direct current into the display apparatus deteriorates the reliability of the display apparatus and the display qualities.

Therefore, it is preferable that, in repeating the step of providing the idle period T2 after a scanning period T1 is provided twice or more, potentials of a pixel electrode and/or an opposite electrode of each of the pixels are controlled so that a polarity of a potential difference between the pixel electrode and the opposite electrode changes from one scanning period T1 to next.

In the present invention, in order to change the polarity of the potential difference between the pixel electrode and the opposite electrode every idle period T2, for example, the following methods may be applied, in repeating the step of providing the idle period T2 after the scanning period T1 is provided twice or more. A method (I) is to control at least one of the potentials of the pixel electrode and the opposite electrode of the pixel so as to change the polarity of the potential difference between the pixel electrode and the opposite electrode from one scanning period T1 to next, where the idle period T2 is provided after the scanning period T1 is provided in an odd number of times; a method (II) is to control at least one of the potentials of the pixel electrode and the opposite electrode of the pixel so that the polarity of the potential difference between the pixel electrode and the opposite electrode during the scanning period T1, which is immediately after the idle period T2, is identical with that during the idle period T2 immediately before the scanning period T1, and so that the polarity of the potential difference during the scanning period T1 until next provision of the idle period T2 is changed from one scanning period T1 to next, where the idle period T2 is provided after the scanning period T1 is provided in an even number of times; or a method (III) is to control at least one of the potentials of the pixel electrode and the opposite electrode of the pixel so that the polarity of the potential difference between the pixel electrode and the opposite electrode during the scanning period T1 immediately after the idle period T2 is different from that during the idle period T2 immediately before the scanning period T1, where the polarity of the potential difference during the scanning period T1 until the next provision of the idle period T2 is not changed from one scanning period T1 to next.

In other words, the display apparatus may be adopted that for example, the control means (such as the control IC 5 shown in FIG. 2) (i) controls at least one of the potentials of the pixel electrode and the opposite electrode of the pixel so that the polarity of the potential difference between the pixel electrode and the opposite electrode is changed from one scanning period T1 to next, where the idle period T2 is provided after the scanning period T1 is provided in an odd number of times, in repeating the step of providing the idle period T2 after the scanning period T1, during which the scanning is performed once, is provided twice or more; (ii) controls at least one of the potentials of the pixel electrode and the opposite electrode of the pixel so that the polarity of the potential difference between the pixel electrode and the opposite electrode during the scanning period T1 immediately after the idle period T2 is identical with that during the idle period T2 immediately before the scanning period T1, while the polarity of the potential difference is changed every scanning period T1 during the scanning periods T1 until the next idle scanning period, where the idle period T2 is provided after the scanning period T1 is provided in an even number of times, in repeating the step of providing the idle period T2 after the scanning period T1, during which the scanning is performed once, is provided twice or more; or (iii) controls at least one of the potentials of the pixel electrode and the opposite electrode so that the polarity of the potential difference between the pixel electrode and the opposite electrode during the scanning period T1 immediately after the idle period T2 is different from that during the idle period T2 immediately before the scanning period T1, where the polarity of the potential difference during the scanning period T1 until the next provision of the idle period T2 is not changed from one scanning period T1 to next, in repeating the step of providing the idle period T2 after the scanning period T1, during which the scanning is performed once, is provided twice or more.

Figure 19:
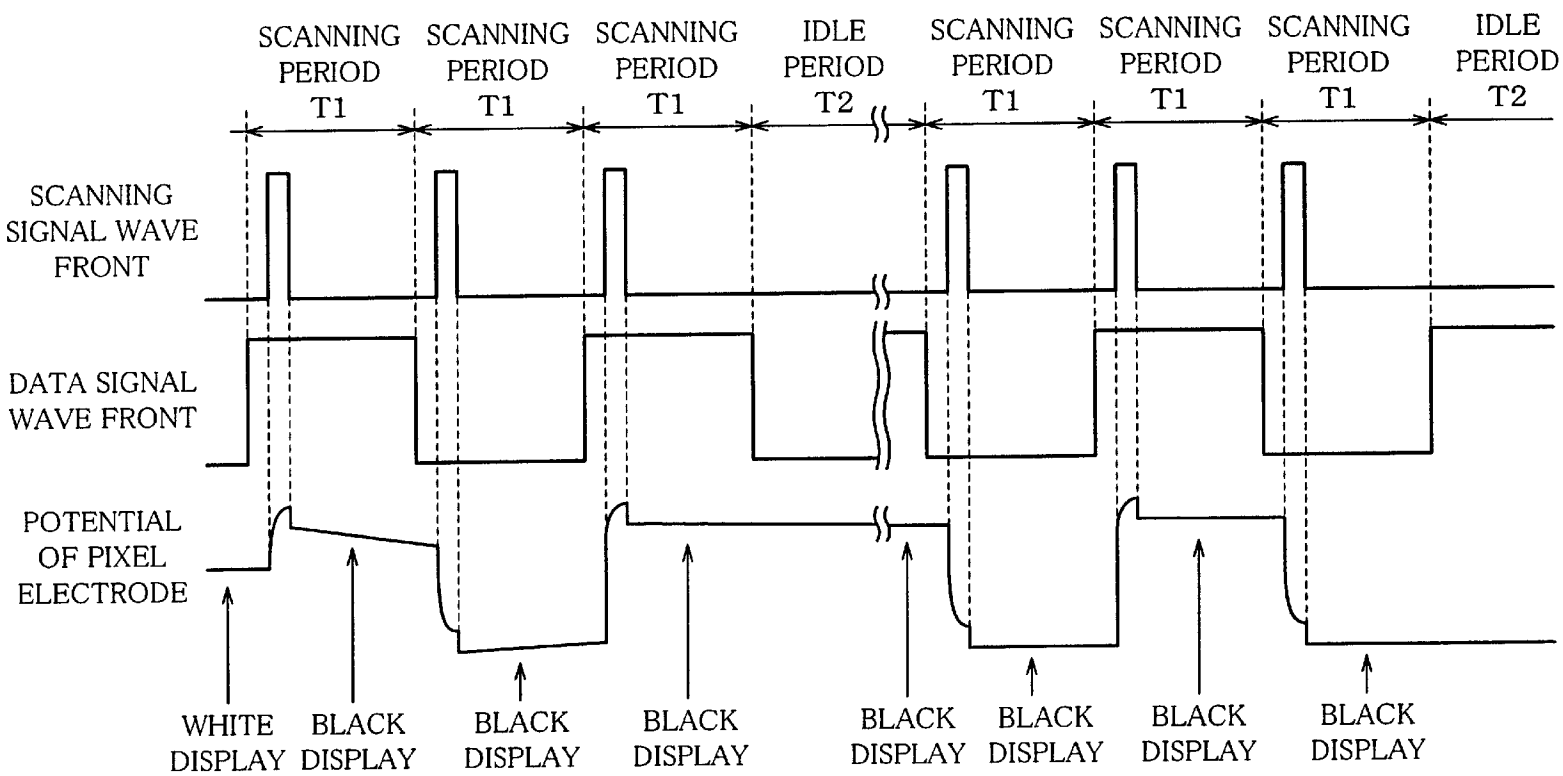
FIG. 19 is a timing chart explaining a method of actuating the display apparatus of the embodiment of the present invention by A.C. driving.

To begin with, the method (I) is explained below, referring to a timing chart shown in FIG. 19 by way of example. In this case, for example, as shown in FIG. 19, the positive voltage for the black display is applied into the liquid crystal in the first scanning period T1, while the negative voltage is applied in the liquid crystal in the second scanning period T1 and the positive voltage is applied in the liquid crystal in the third scanning period T1. In this way, the polarity of the voltage applied into the liquid crystal is changed from one scanning period T1 to next. In the idle period T2 following the scanning periods T1, the positive voltage is maintained in the liquid crystal. Then, in the first scanning period T1 immediately after the idle period T2, the negative voltage is applied into the liquid crystal because the liquid crystal maintains the positive voltage at the time. In the following, in the second scanning period T1, the positive voltage is applied, while the negative voltage is applied in the liquid crystal in the third scanning period T1. In this way, again, the polarity of the voltage applied into the liquid crystal is changed from one scanning period T1 to next. As a result, the negative voltage is maintained in the liquid crystal in the following idle period T2. Therefore, the polarity of voltage in the liquid crystal during the idle period T2 is changed from one idle period T2 to next.

In addition, as discussed above, the scanning during one scanning period T1 takes about 16.7 msec in case of the normal driving, so that the liquid crystal has the responding speed in a range of from 40 to 50 msec. Therefore, the normal display can be performed by repeating the repeating interval three times.

However, how many times the scanning is needed to be performed depends on which raw material is used in the display apparatus, how much is the driving timing, how long is the scanning period, how fast is the responding speed, how much is a difference between dielectric constants of the white display and the black display of the liquid crystal, how much is a capacitance of the liquid crystal with respect to a total capacitance of the pixels, and the like condition.

Although explained in FIG. 19 is a case where the scanning period T1 are provided in three times when the scanning period T1 is provided in an odd number of times (that is, the scanning period T1 is provided in the odd number of times between the idle periods T2), however, the present invention is not limited to this, and the scanning period T1 may be provided in any number of times, provided that the scanning period T1 is provided in a plural and odd number of times.

Figure 20:
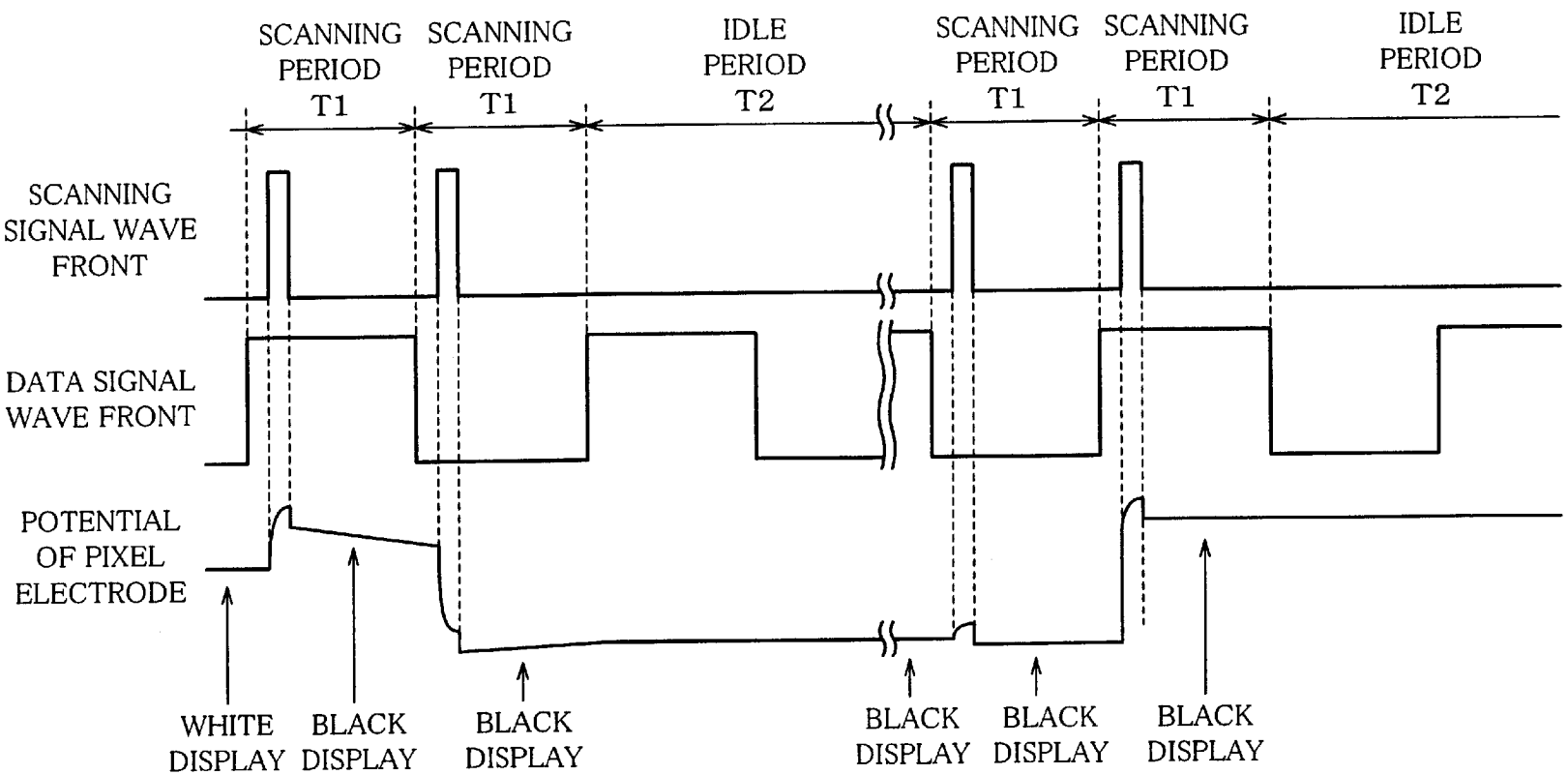
FIG. 20 is a timing chart explaining another method of actuating the display apparatus of the embodiment of the present invention by A.C. driving.

Moreover, although the scanning period T1 is provided three times in FIG. 19, the normal display can be achieved by providing the scanning period T1 twice, in case the liquid crystal has a fast responding speed. Thus, discussed below is the method (II) wherein the scanning period T1 is provided twice when the scanning period T1 is provided in an even number of times (that is, the scanning period T1 is provided in the even number of times between the idle periods T2) as shown in FIG. 20. However, it should be noted that the present invention is not limited to this, and the scanning period T1 may be provided in any number of times, provided that the scanning period T1 is provided in a plural and even number of times.

In FIG. 20, the positive voltage for the black display is applied into the liquid crystal in the first scanning period T1, and the negative voltage is applied into the liquid crystal in the second scanning period T1. In this manner, the polarity of the voltage is changed from one scanning period T1 to next. As a result, in the following idle period T2, the negative voltage is maintained in the liquid crystal. Then, in the first scanning period T1 immediately after the idle period T2, the negative voltage is applied into the liquid crystal, similarly to the polarity of the idle period T2. In the following second scanning period T2, the positive voltage is applied. In this manner, again, the polarity of the voltage applied in the liquid crystal is changed from one scanning period T1 to next. As a result, the positive voltage is maintained in the liquid crystal in the idle period T2 thereafter. Thus, the polarity of the voltage maintained in the liquid crystal during the idle period T2 is changed from one idle period T2 to next.

With the method (I) or (II), the polarity of the potential difference is changed each time of scanning. In other words, for example, the polarity of the voltage applied into the liquid crystal is changed from one time of scanning to next. Moreover, with the method (I) or (II), it is possible to change the polarity of the potential difference during the idle period T2, from one idle period T2 to next, so that, for example, the voltage maintained in the liquid crystal during the idle period T2 can be changed from one idle period T2 to next. For this reason, with the method (I) or (II), the A.D. driving of the liquid crystal is possible, thereby preventing the deterioration of the reliability and the display qualities of the liquid crystal. In other words, with the method (I) or (II), the display apparatus suitable for A.D. driving can have good display qualities and low electricity consumption.

Figure 21:
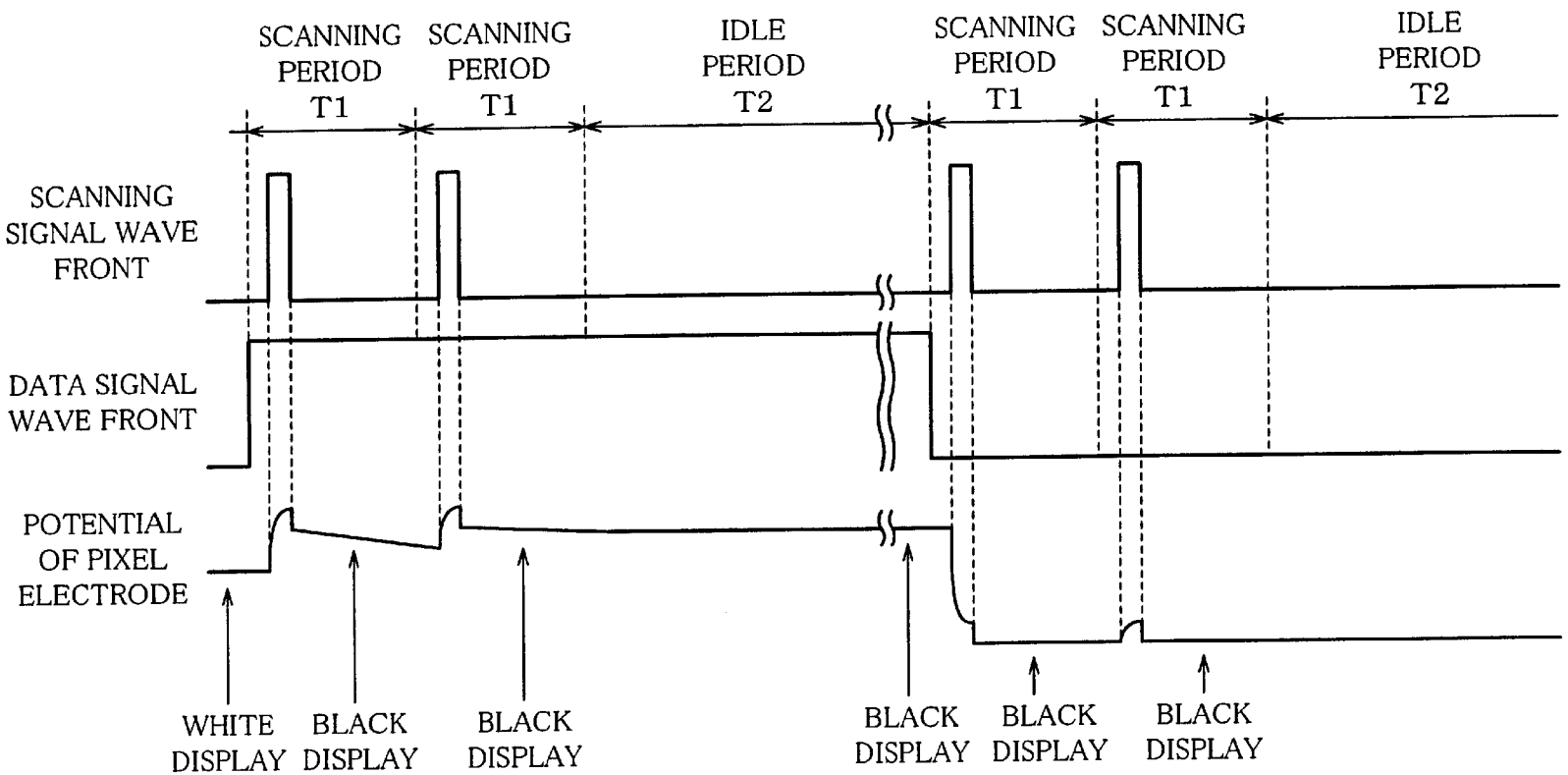
FIG. 21 is a timing chart explaining still another method of actuating the display apparatus of the embodiment of the present invention by A.C. driving.

Next, described is the method (III), with reference to a timing chart shown in FIG. 21 by way of example. In this case, for example as shown in FIG. 21, the positive voltage for the black display is applied into the liquid crystal in the first scanning period T1. Thereafter, the positive voltage is applied into the liquid crystal during all the scanning period T1 until the idle period T2. More specifically, as shown in FIG. 21, where the scanning period T1 is provided twice, followed by the idle period T2, if the positive voltage is applied into the liquid crystal in the first scanning period T1, the positive voltage is applied into the liquid crystal in the second scanning period T1, too. As a result, in the following idle period T2, the positive voltage is maintained in the liquid crystal. Then, the first scanning period T1 immediately after the idle period T2, the negative voltage is applied into the liquid crystal, because the positive voltage is maintained in the liquid crystal. Thereafter, in all the scanning period T1 until the next idle period T2, the negative voltage is applied into the liquid crystal. As a result, the negative voltage is maintained in the liquid crystal in the next idle period T2. In this way, the polarity of the voltage maintained in the liquid crystal during the idle period T2 is changed from one idle period T2 to next.

With the method (III), at least with respect to the idle period T2, which shares a large portion of the repeating interval, during which repeated is the step of providing the idle period T2 after the scanning period T1, during which the screen is scanned once, is provided twice or more, the polarity of the potential difference during the idle period T2, for example, the polarity of the voltage maintained in the liquid crystal during the idle period T2, is changed from one idle period T2 to next, thus making it possible to perform the A.D. driving of the liquid crystal. Because of this, it is possible to prevent the deterioration of the reliability and the display qualities of the liquid crystal. Therefore, again with the method (III), the display apparatus suitable for A.D. driving can have good display quality and low electricity consumption.

Note that, in FIG. 21, explained is a case where the scanning period T1 is provided twice when the scanning period T1 is provided twice or more (that is, the scanning period T1 is provided twice or more between the idle periods T2). However, the present invention is not limited to this. In case the method (III) is employed, the number of times of the provision of the scanning period T1 between the idle period T2 may be even or odd, as long as the number is two or more.

Moreover, the explanations of the methods (I) to (III) discuss referring to the timing chart wherein the idle period T2 is provided after the scanning period T1 is provided two or more successive times. However, the present invention is not limited to this. The use of the methods can obtain the same effects in case the vertical blanking period or the non-scanning period shorter than the idle period T2, between the respective scanning periods T1.

Further, FIGS. 19–21 illustrate a method to change (control) the polarity of the voltage across the liquid crystal by changing (controlling) the potential of the pixel electrode. However, the invention is not limited to this. As mentioned in the foregoing, the polarity of the voltage across the liquid crystal may be changed (controlled) by changing (controlling) the potential(s) of the pixel electrode and/or the opposite electrode, so as to drive the liquid crystal with an alternating current.

For example, in the liquid crystal display shown in FIGS. 3, 4, preferably, either the potential of the pixel electrode 27 or the potentials of both the pixel electrode 27 and the transparent common. electrode 19 are controlled so that the pixel electrode 27 and the transparent common electrode 19 as the opposite electrode develop a potential difference having a polarity which alternates from one idle period T2 to next for each idle period T2. To achieve this, the potentials are controlled of, for example, either the potentials of the data signal lines 32 or the potentials of both the data signal lines 32 and the transparent common electrode 19 while selecting one of the scanning signal lines 31.

For example, to develop a potential difference of ±5 V across the liquid crystal (to produce a black display), a voltage of +5 V or −5 V is applied to the pixel electrode 27 with the transparent common electrode 19 (opposite electrode) at 0 V (A.C. voltage is applied only to the pixel electrode 27). Alternatively, a voltage of −3 V or +3 V is applied to the transparent common electrode 19 and a voltage of +2 V (when a voltage of −3 V is applied to the transparent common electrode 19) or −2 V (when voltage of +3 V is applied to the transparent common electrode 19) is applied to the pixel electrode 27 (A.C. voltage is applied to both the pixel electrode 27 and the transparent common electrode 19).

As further alternatives, to develop a ±3 V voltage across the liquid crystal (to produce a halftone display), either a voltage of +3 V or −3 V is applied to the pixel electrode 27 with the transparent common electrode 19 (opposite electrode) at 0 V (A.C. voltage is applied only to the pixel electrode 27) or applied to the transparent common electrode 19 with the pixel electrode 27 at 0 V (A.C. voltage is applied to both the pixel electrode 27 and the transparent common electrode 19).

Incidentally, FIGS. 3, 4 illustrate a liquid crystal display in which the pixel electrodes 27 and the transparent common electrode 19 as the opposite electrode are provided on oppositely positioned, individual glass substrates 11, 12; however, the display apparatus of the invention is not limited to this.

The display apparatus may be arranged, for example, based on an IPS (in-plane-switching) scheme by which the pixel electrodes and the opposite electrode are formed on a single substrate. Alternatively, the display apparatus may be a hyper LCD (liquid crystal display) in which data signal lines are formed on pixel electrodes and a substrate opposite to the pixel electrodes. In this case, the pixels are driven by changing only the data signals fed to the data signal lines provided to the opposite substrate side.

That is, in the present embodiment, the pixel electrode and/or opposite electrode include that pixel electrode and/or opposite electrode which are found in display apparatuses of IPS schemes and in hyper LCDs. In this manner, the method is applicable not only to liquid crystal displays, but also to any display apparatus which suitably operates with alternating current drive.

Another problem in driving the display apparatuses, as mentioned in the foregoing, is that the responding speed is low and, when the capacity varies due to applied voltage, the responding speed of the display becomes slower than the rewrite cycle of the picture, which degrades display quality. This problem occurs when displaying a constantly changing dynamic picture or switching from still picture to dynamic picture, as well as at other times when the displayed image is changed.

Accordingly, the display apparatus includes detection means (detection section) which detects a change in an image to be displayed, and the control means (control section) switches the drive of the display operation, that is, the display apparatus, when there is no change in an image to be displayed and when there has been a change in an image to be displayed, according to a result of the detection by the detection means. Optimum response and display quality as well as lower electric consumption, are achieved for every kind of display image including still pictures and dynamic pictures.

Figure 11:
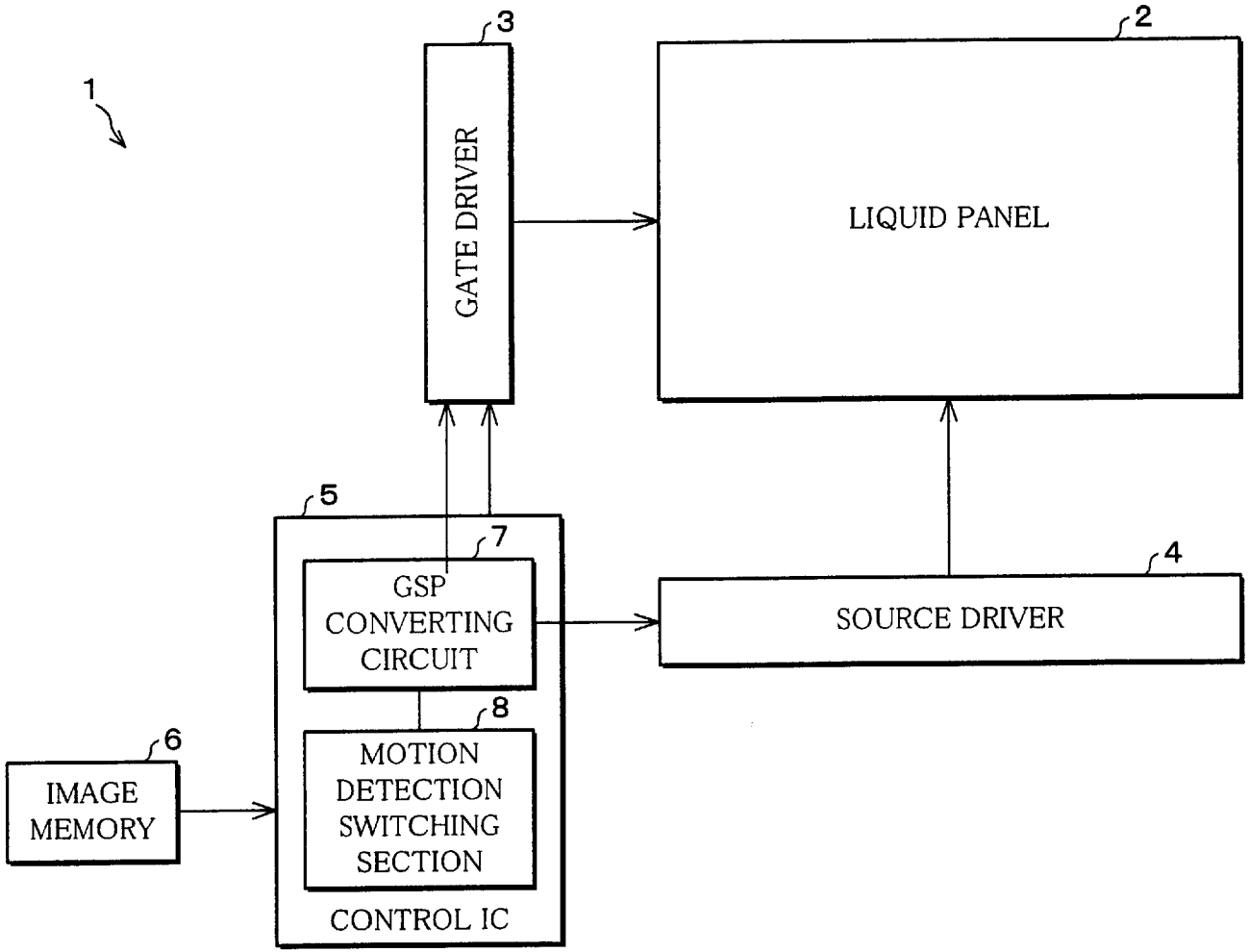
FIG. 11 is a system block diagram illustrating another arrangement of the display apparatus using the driving method of the display apparatus of the embodiment of the present invention.

That is, the liquid crystal display 1 of the present embodiment, as shown in FIG. 11, may include the motion detection switching section 8 (detection means, switching means) in the control IC 5.

The motion detection switching section 8 is a circuit which detects a change in the image to be displayed has changed, that is, whether the image to be displayed has changed or not, for example, whether the image to be displayed is a dynamic picture or a still picture.

Figure 12:
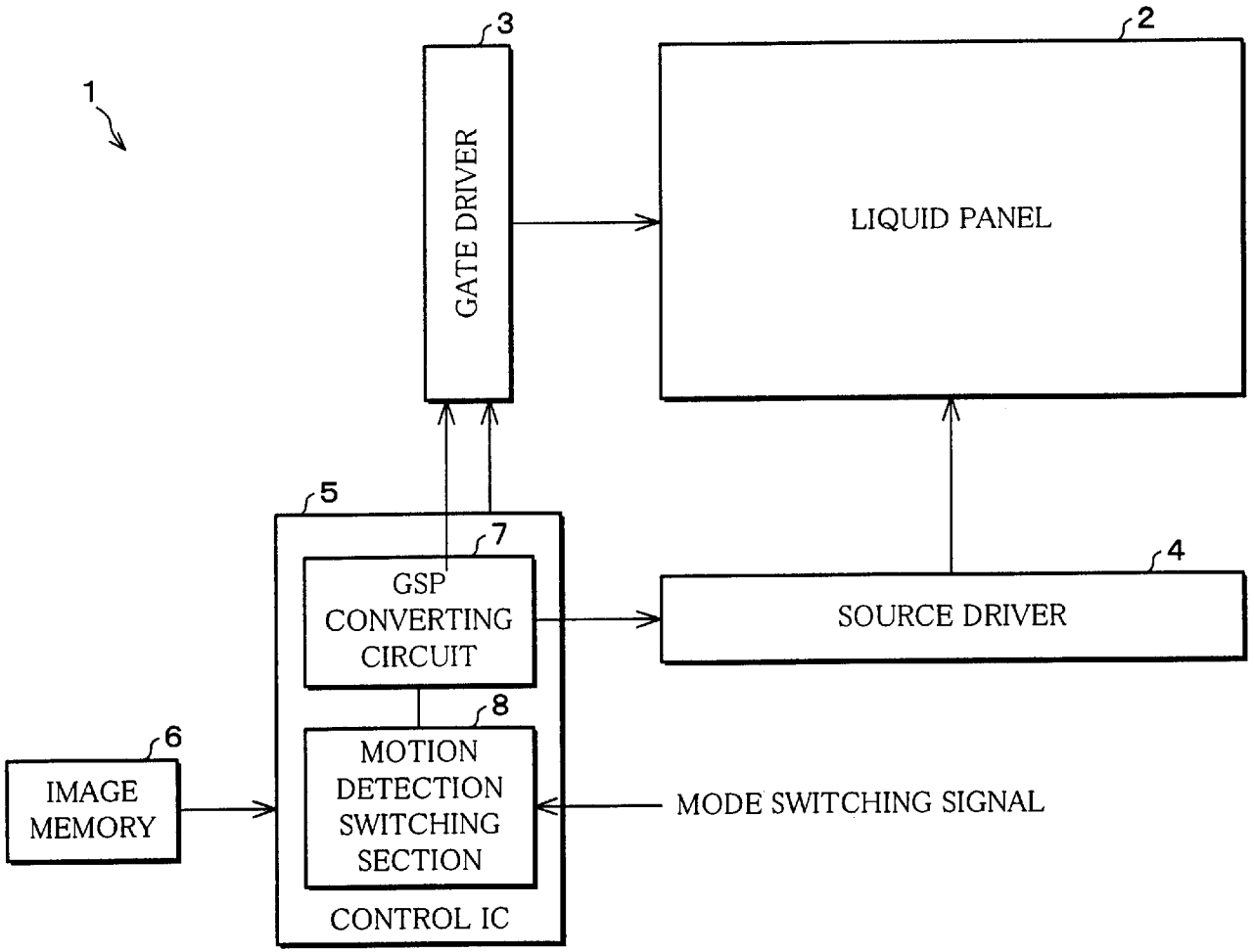
FIG. 12 is a system block diagram showing still another arrangement of the display apparatus of the embodiment of the present invention.

The motion detection switching section 8 is, as shown in FIG. 11, may be adapted so as to detect a change in the image to be displayed by detecting whether the image data fed at a constant interval from the image memory 6 has changed or not changed like a still picture. Alternatively, the motion detection switching section 8, as shown in FIG. 12, may be adapted so as to detect a change in the image to be displayed by specifying whether there is a motion or not in the image based on, for example, a mode switching signal fed from the outside of the control IC 5.

When the motion detection switching section 8 detects a change in the image to be displayed by detecting whether the image data fed at a constant interval from the image memory 6 has changed or not changed like a still picture, the motion detection switching section 8 may be, for example, a circuit arranged from a frame memory and a comparator.

When the motion detection switching section 8 detects a change in the image to be displayed by specifying whether there is a motion or not in the image based on, for example, a mode switching signal fed from the outside of the control IC 5, the motion detection switching section 8 functions as a mode switching signal receiving section in the control IC 5, for example.

The motion detection switching section 8 may include, for example, a scan-mode switching (selecting) switch which is switches between scan modes under the control of the control IC 5. The scan modes are, for example, still mode, change mode, and dynamic picture mode.

The liquid crystal display 1 may have the scan-mode (e.g., still mode, change mode, dynamic picture mode) switching (selecting) switch on the housing of the liquid crystal display 1 for convenient use. That is, the liquid crystal display 1 may be such that the scan mode (e.g., still mode, change mode, dynamic picture mode) can be switched from the outside. In this case, the liquid crystal display 1 execute a specified scan mode by the control of the control IC 5 in the scan mode specified (selected) by the external scan-mode switching (selecting) switch and detected by the motion detection switching section 8.

Incidentally, FIGS. 11, 12 illustrate an arrangement in which the motion detection switching section 8 is integrated to the control IC 5. Alternatively, the motion detection switching section 8 may be provided separately from the control IC 5.

With the liquid crystal display 1, the GSP converting circuit 7 is controlled in accordance with a result of the detection by the motion detection switching section 8 to switch between a single scanning period T1 or multiple scanning periods T1.

That is, in the liquid crystal display 1, when there is no change in an image to be displayed, all the scanning signal lines are caused to be in a non-scanning state for a period longer than a time taken to scan the screen once after the screen is scanned once, and when there has been a change in an image to be displayed, all the scanning signal lines are caused to be in a non-scanning state for a period longer than a time taken to scan the screen once after the screen is scanned twice or more.

Figure 8:
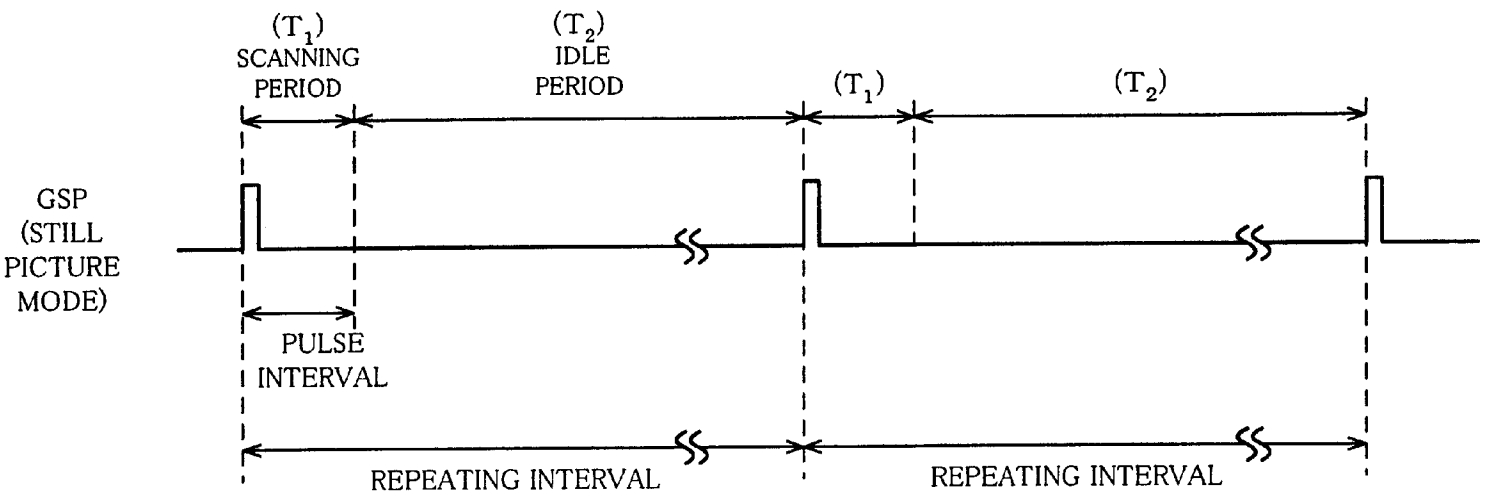
FIG. 8 is a timing chart explaining how the display apparatus is driven in a still picture mode.

Specifically, normally, that is, when, for example, displaying a motionless still picture, as shown in FIGS. 5, 6, 8, a display is produced by repeat an operation (repetition interval) to provide an idle period T2 after providing a scanning period T1 only once. In other words, when the scan mode is set to still mode, the scanning periods T1 and the idle periods T2 are provided alternately.

Figure 9:
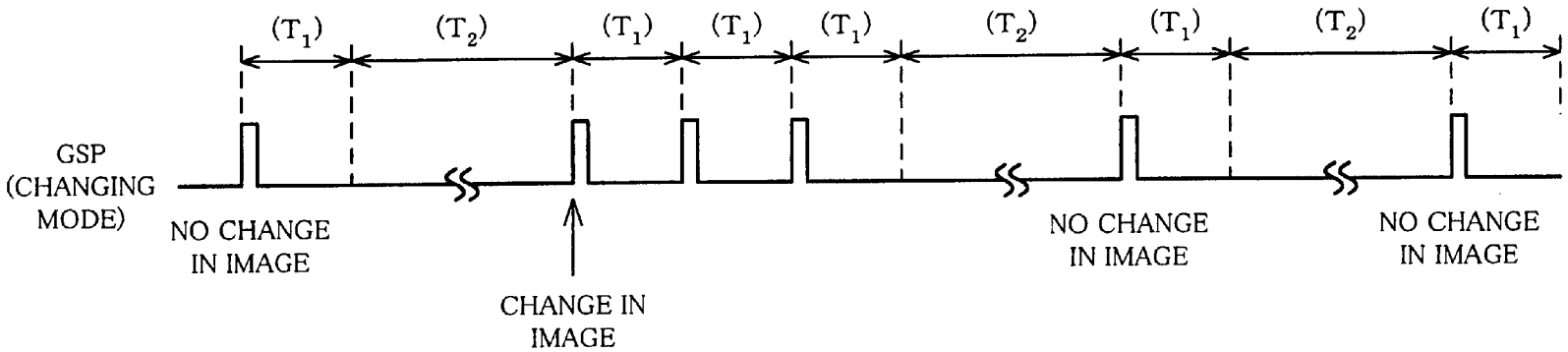
FIG. 9 is a timing chart explaining how the display apparatus is driven in a changing mode.

When the display is switched from a dynamic picture to a still picture, for example, when the image data switches with a certain constant interval, such as when a dynamic picture with few motions is to be displayed, the scan mode is set to change mode. Specifically, as shown in FIG. 9, only when image data changes, that is, only when the image to be displayed is switched (changed), an idle period T2 is provided after providing the scanning period. T1 twice or more (three times in the liquid crystal display 1), and thereafter the scanning periods T1 and the idle periods T2 are provided alternately. That is, when there is no change in an image to be displayed, the scanning periods T1 and the idle periods T2 are provided alternately.

Figure 10:
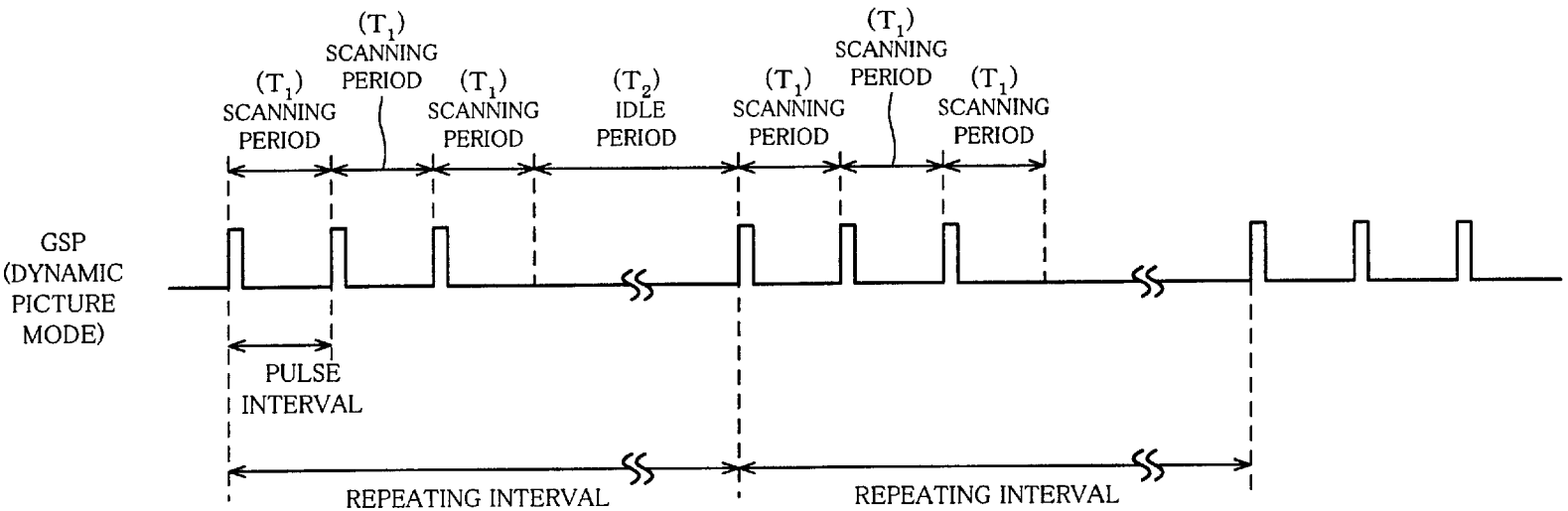
FIG. 10 is a timing chart explaining how the display apparatus is driven in a dynamic picture mode.

When displaying, for example, a dynamic picture which changes constantly, as shown in FIGS. 1, 10, a display is produced by rewriting the pictures one after the other through the repeating of a repetition interval in which an idle period T2 is provided after successively repeating a pulse interval (scanning period T1) of a gate start pulse signal GSP twice or more (three times with the liquid crystal display 1) That is, when the scan mode is set to dynamic picture mode, the scanning period T1 is repeated twice or more, and thereafter, the drive to provide the idle period T2 is repeated. Incidentally, the dynamic picture mode corresponds to the case when an image change changes successively in change mode.

The driving enables a display corresponding to a change in the image, prevents degradation of the image from happening, and achieves reductions in. electric consumption, without carelessly increasing the number of scans. Incidentally, the idle period T2 may of course entirely or partly be a suspension period.

In other words, the method of driving a display apparatus of the present embodiment may be a method of driving a display apparatus including a screen which has pixels arranged in a matrix and producing a display by applying a scanning signal to scanning signal lines connected to the pixels a line at a time and thus selecting a line to scan the screen sequentially, for example, and also by supplying a data signal to those pixels on the selected line via data signal lines and provide, when there is no change in an image to be displayed, an idle period in which all the scanning signal lines are caused to be in a non-scanning state for a period longer than a scanning period in which the screen is scanned once after the scanning period and when there has been a change in an image to be displayed, the idle period after the screen is scanned twice or more.

Alternatively, a display apparatus of the present embodiment may be a display apparatus including a screen which has pixels arranged in a matrix and producing a display by applying a scanning signal to scanning signal lines connected to the pixels a line at a time and thus selecting a line to scan the screen sequentially, for example, and also by supplying a data signal to those pixels on the selected line via data signal lines and include: control means for controlling the drive of the display apparatus; and detection means for detecting a change in an image to be displayed, wherein according to a result of the detection by the detection means, the control means causes, when there is no change in an image to be displayed, all the scanning signal lines to be in a non-scanning state for a period longer than a time taken to scan the screen once after the screen is scanned once and, when there has been a change in an image to be displayed, all the scanning signal lines to be in a non-scanning state for a period longer than a time taken to scan the screen once after the screen is scanned twice or more.

According to the present embodiment, as mentioned in the foregoing, by at least providing, when there has been a change in an image to be displayed, the idle period after the screen is scanned twice or more, sufficient reduction in electric consumption can be readily achieved while ensuring a sufficient display responding speed is ensured and satisfying basic display quality requirements, such as brightness, contrast, responding speed, and gradient.

Especially, by scanning the screen only once when there is no change in an image to be displayed and repeatedly twice or more only when the display is switched, that is, when there has been a change in an image to be displayed, optimum response and display quality, as well as lower electric consumption, are achieved for every kind of display image including still pictures and dynamic pictures. In addition, the number of times to rewrite the picture, that is, the output time of the data signal, can be further reduced and the electric consumption can also be further reduced, while ensuring a sufficient display responding speed and satisfying basic display quality requirements, such as brightness, contrast, responding speed, and gradient.

In the method of driving the display apparatus, it is again preferable if the idle period is provided after the scanning period is provided twice or more successive times when there has been a change in an image to be displayed.

Further, in the display apparatus, it is again preferable if when there has been a change in an image to be displayed, the control means causes all the scanning signal lines to be in a non-scanning state for a period longer than a scanning period in which the screen is scanned once after providing the scanning period in the screen is scanned once twice or more successive times.

Further, it is preferable if when the image to be displayed has changed in the display apparatus, that is, when the idle period T2 is provided after the scanning period T1 is provided twice or more, when the foregoing operation is repeated, both good display quality and electric consumption reduction can be achieved by employing any one of the foregoing methods (I)–(III), in other words, any one of the arrangements (i)–(iii) to implement the methods (I)–(III).

A method of driving a display apparatus in accordance with the invention may include the foregoing arrangement and in addition may provide, in the idle period, a suspension period in which a circuit irrelevant to display is stopped operating.

According to the method, in the idle period, there is provided a suspension period in which a circuit irrelevant to display is stopped operating; therefore, the electric power which otherwise would be consumed by the circuit irrelevant to display in the idle period is saved. Thereby, the display apparatus overall consumes less electric power.

Alternatively, in the invention, to switch the drive of the display apparatus when there is no change in an image to be displayed and when there has been a change in an image to be displayed, by scanning the screen at least once and preferably twice or more at a rewrite cycle longer than a normal rewrite cycle (predetermined rewrite cycle) when there is no change in an image to be displayed and at a normal rewrite cycle (predetermined rewrite cycle) only when there has been a change in an image to be displayed, optimum response and display quality, as well as lower electric consumption, can be achieved for every kind of display image including still pictures and dynamic pictures.

That is, for example, in the liquid crystal display 1, by controlling a GSP converting circuit with the control IC 5 and changing the pulse interval of the gate start pulse signal GSP, according to a result of the detection by the motion detection switching section 8, depending on whether to produce a still picture display or a dynamic picture display, optimum response and display quality, as well as lower electric consumption, can be achieved for every kind display image including still pictures and dynamic pictures.

Figure 13:
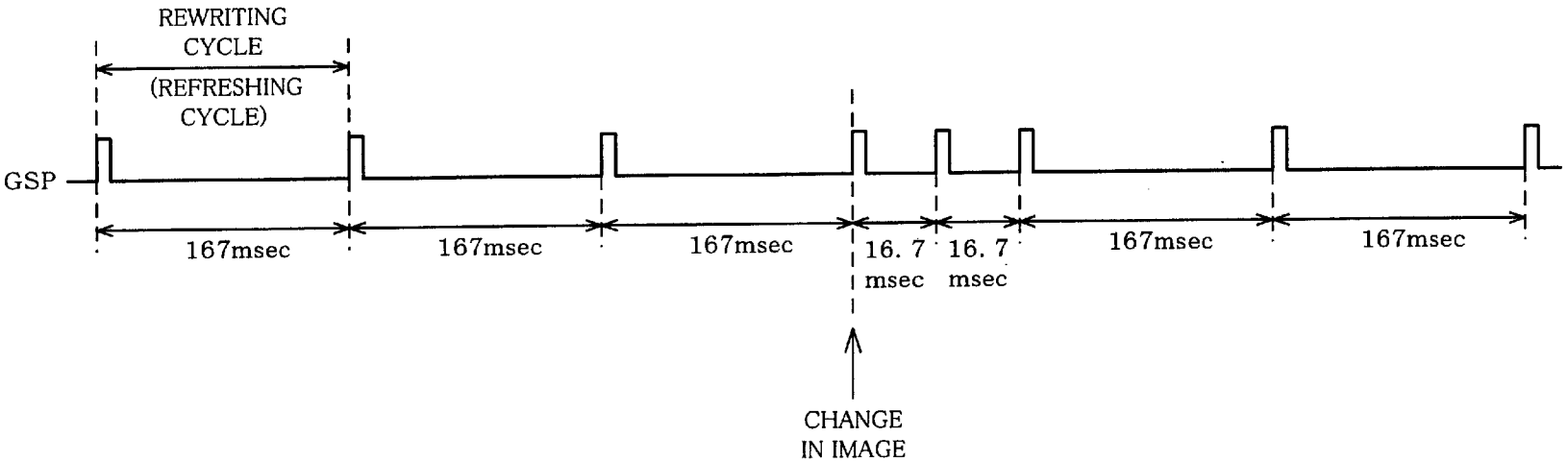
FIG. 13 is a timing chart explaining how the display apparatus of the embodiment of the present invention is driven with another driving method.
Figure 14:
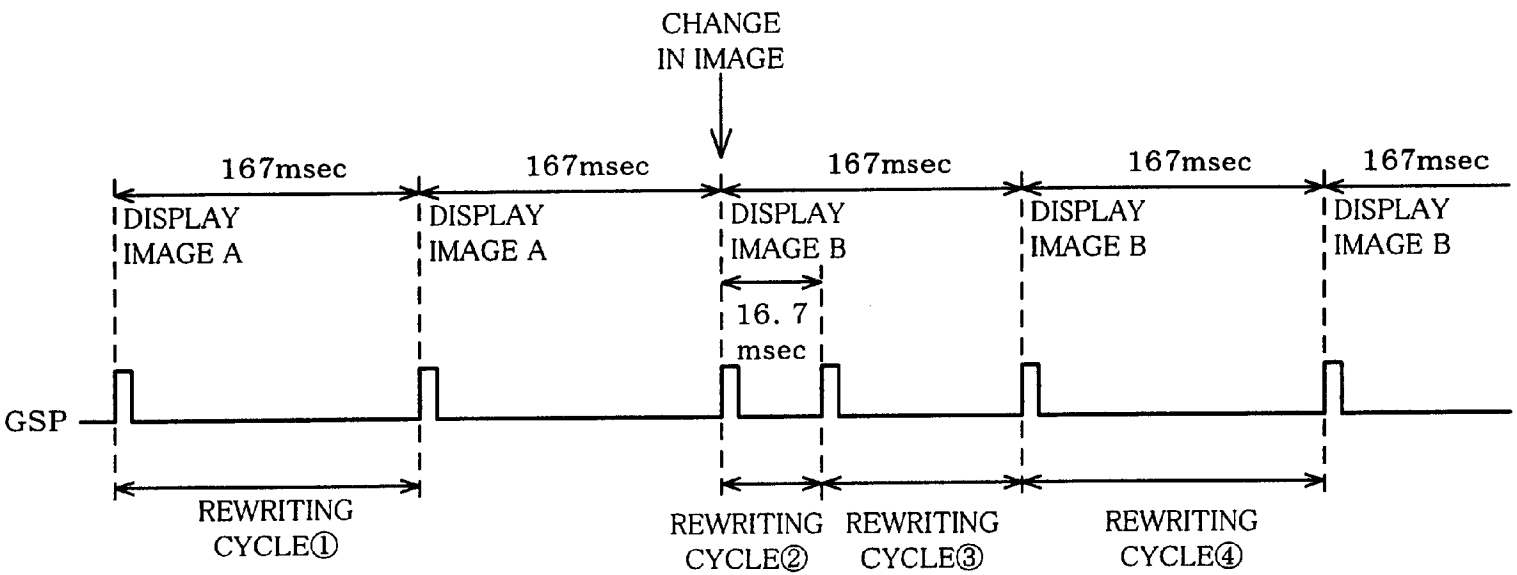
FIG. 14 is a timing chart explaining how the display apparatus of the embodiment of the present invention is driven with still another driving method.
Figure 15:
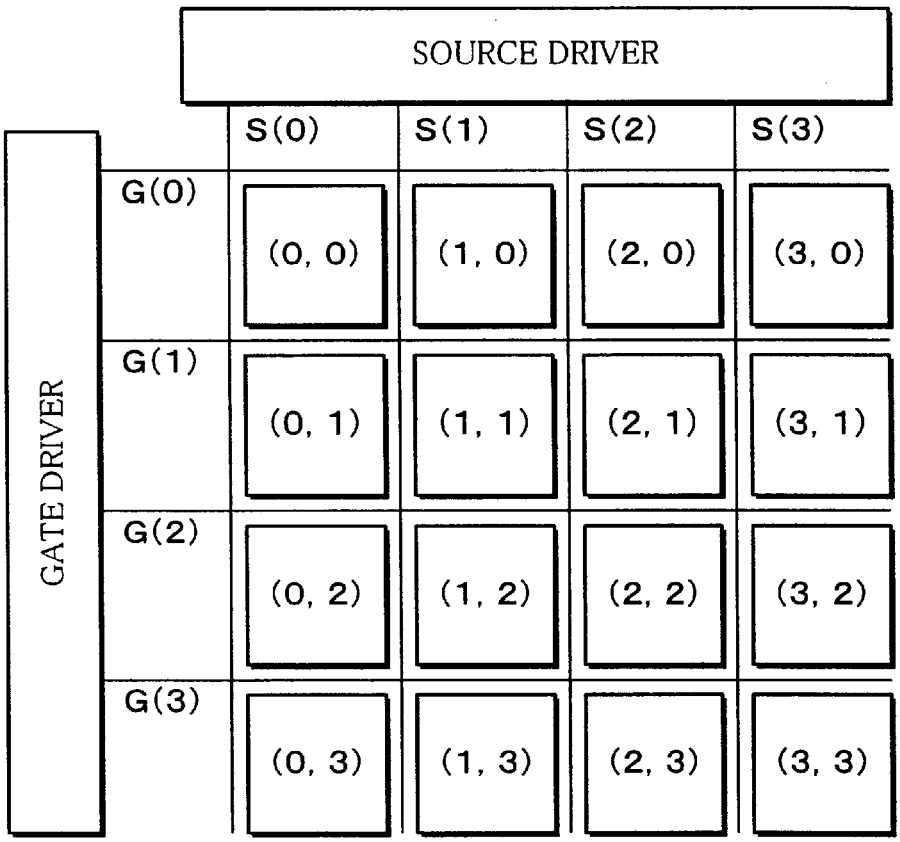
FIG. 15 is a block diagram illustrating a matrix-type display apparatus.

Specifically, for example, when a normal NTSC scanning period (a blanking period may be provided where necessary, in which case the sum of the scanning period and the blanking period) is 16.7 msec, that is, the pulse interval of the gate start pulse signal GSP is about 16.7 msec (that is, as mentioned in the foregoing, the frame frequency for display is normal 60 Hz), as shown in FIG. 13 or 14, by setting the rewrite cycle (that is, refresh cycle) to 167 msec, which is ten times the normal value, when there is no change in an image to be displayed, electric consumption can be reduced. Incidentally, in the NTSC system, the rewrite cycle corresponds to the vertical period.

In this manner, when the rewrite cycle is long in a scanning period (scanning period T1), if there is a change in the image, by scanning the screen at a normal rewrite cycle (16.7 msec in this case) at least once, preferably twice or more as shown in FIG. 13, a change in the image can be quickly reflected in the result.

That is, for example, when the image changes from A to B, by interposing a scanning period at least once which is shorter than a rewrite cycle (refresh cycle) between two rewrite cycles (two vertical periods), the display better and more quickly follows the image change from A to B. Here, by interposing a scanning period which is shorter than a rewrite cycle (refresh cycle) twice or more (for example, twice as shown in FIG. 13 or preferably, for example, three times as mentioned in the foregoing) between rewrite cycles (two vertical periods), pixels are sufficiently charged.

The following will describe in detail the scan method, that is, the driving method of the present embodiment in reference to FIG. 14, taking as an example a case where a short rewrite cycle ② (16.7 msec in the example) is interposed between other two rewrite cycles ① and ② when the display image is switched from A to B.

In FIG. 14, the rewrite cycle ② (for example, 16.7 msec) is set shorter than the rewrite cycles ①, ③, ④ (for example, 167 msec). The shorter the rewrite cycle ②, the better the display follows the image change. The rewrite cycle ② is therefore preferably short. However, if it is excessively short, it is obvious that the pixels will not be sufficiently charged. It is therefore preferable if the rewrite cycle ② is more than a predetermined value (here, 16.7 msec) which is determined in accordance with charging characteristics of individual display devices. Therefore, the rewrite cycle ② is, preferably, set equal to the cycle (here, 16.7 msec) in normal refresh mode.

Incidentally, the rewrite cycles ①, ④ are low refresh mode, and these rewrite cycles are both set to 167 msec in FIG. 14; however, the rewrite cycles may differ from each other.

Although the rewrite cycle ③ was defined as the remainder in the substraction of the rewrite cycle ② (16.7 msec in FIG. 14) from the rewrite cycle ① or ④ (167 msec in FIG. 14), the rewrite cycle ③ does not have to be strictly defined. This is because in FIG. 14, the sum of the rewrite cycles ① and ④ and the sum of the rewrite cycles ② and ③ are both set to 167 msec, whereas the rewrite cycle ② is normally set sufficiently shorter than the other rewrite cycles ①, ③, ④, for example, to 16.7 msec, and the rewrite cycle ③ is therefore close to the rewrite cycle ① or ④.

Incidentally, in FIG. 14, as to the rewrite cycles ①, ③, ④, the individual periods may wholly be a scanning period. Alternatively, each period may be arranged from a sum of a scanning period and an idle period, for example.

In the latter case, cutting the rewrite cycle ② short allows extending the period for the rewrite cycle ③ and thus the idle period in the period for the rewrite cycle ③, and therefore contributes more to reduction in electric consumption. In the former case, the display better follows image changes.

In this manner, by scanning the screen at least once, preferably twice or more, for example, successively at a rewrite cycle longer than a predetermined rewrite cycle when there is no change in an image to be displayed and at a predetermined rewrite cycle, that is, for example, a rewrite cycle determined in accordance with charging characteristics, etc. of the display when there has been a change in an image to be displayed, the display can better and more quickly follow image changes.

That is, a method of driving a display apparatus of the present embodiment may include a screen which has pixels arranged in a matrix and producing a display by applying a scanning signal to scanning signal lines connected to the pixels a line at a time and thus selecting a line to scan the screen sequentially, for example, at a predetermined rewrite cycle and also by supplying a data signal to those pixels on the selected line via data signal lines and include the step of scanning the screen at least once, preferably, twice or more, at a rewrite cycle longer than a predetermined rewrite cycle when there is no change in an image to be displayed and at the predetermined rewrite cycle only when there has been a change in an image to be displayed.

According to the method, to drive the display apparatus, the screen is scanned at a cycle longer than a predetermined rewrite cycle when there is no change in an image to be displayed and at the predetermined rewrite cycle when there has been a change in an image to be displayed. Thus, the screen is scanned at a shorter rewrite cycle when there has been a change in an image to be displayed than when there is no change in an image to be displayed. Alternatively, if the rewrite cycle is longer than a predetermined rewrite cycle when there is no change in an image to be displayed, the screen is scanned twice or more, for example, successively when there has been a change in an image to be displayed at a shorter rewrite cycle than when there is no change in an image to be displayed.

Alternatively, a display apparatus of the present embodiment may be a display apparatus including a screen which has pixels arranged in a matrix and producing a display by applying a scanning signal to scanning signal lines connected to the pixels a line at a time and thus selecting a line to scan the screen sequentially, for example, at a predetermined rewrite cycle and also by supplying a data signal to those pixels on the selected line via data signal lines and include: control means for controlling the drive of the display apparatus; and detection means for detecting a change in an image to be displayed, wherein the control means controls application of the scanning signal to the scanning signal lines according to a result of the detection by the detection means so that the screen is scanned at least once, preferably, twice or more, for example, successively at a rewrite cycle longer than a predetermined rewrite cycle when there is no change in an image to be displayed and at the predetermined rewrite cycle only when there has been a change in an image to be displayed.

This further reduces the number of times to rewrite the picture, that is, the output time of the data signal, when there is no change in an image to be displayed. In addition, the electric power consumed in the rewriting of the picture can be reduced in the production of still pictures and other motionless displays (displays of non-animated images) and dynamic picture which include few motions, while ensuring basic display quality requirements, such as brightness, contrast, responding speed, and gradient. Meanwhile, when there has been a change in an image to be displayed, the voltage applied to the pixel electrodes quickly rises to a predetermined voltage level to produce desired luminance, and image changes can be quickly achieved.

As a result, sufficient reduction in electric consumption can be readily achieved while ensuring a sufficient display responding speed and satisfying basic display quality requirements, such as brightness, contrast, responding speed, and gradient.

Incidentally, the foregoing description was directed to sequential scan as an example. The present embodiment is not limited to this. The screen is not necessarily scanned line by line, but may be scanned every alternate or otherwise selected line.

The foregoing description of the present embodiment was directed to a reflective active-matrix liquid crystal display as an example. This is not intended to limit the scope of a method of driving a display apparatus and a display apparatus of the present embodiment in any manner. Example of other display apparatuses to which the embodiment is applicable include simple multiplex liquid crystal displays, EL (electroluminescense) display apparatuses, PDPs (plasma display panels), and giricons. Further, these display apparatuses can be built in mobile telephones, portable game machines, PDAs (Personal Digital Assistants), mobile television sets, remote controls, and laptop computers, as well as other general portable terminals. These portable electronics, often powered by battery, can operate for an extended period of time thanks to the incorporation of the display apparatus of the present invention which reduces electric consumption while retaining good display quality.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a display apparatus including a screen which has pixels arranged in a matrix, said method producing a display by applying a scanning signal to scanning signal lines connected to the pixels and thus selecting a line to scan the screen and also by supplying a data signal to those pixels on the selected line via data signal lines, said method comprising the step of providing, after scanning the screen twice or more, an idle period in which all the scanning signal lines are caused to be in a non-scanning state for a period longer than a time taken to scan the screen once.

2. The method as set forth in claim 1, wherein the idle period is provided after a scanning period in which the screen is scanned once is provided twice or more successive times.

3. The method as set forth in claim 1, wherein in the idle period, there is provided a suspension period in which a circuit irrelevant to display is stopped operating.

4. The method as set forth in claim 1, wherein:

in repeating the step of providing the idle period after a scanning period in which the screen is scanned once is provided twice or more, the idle period is provided after the scanning period is provided an odd number of times; and a potential of a pixel electrode and/or that of an opposite electrode of each of the pixels is/are controlled so that the pixel electrode and the opposite electrode develop a potential difference having a polarity which alternates from one scanning period to next.

5. The method as set forth in claim 1, wherein:

in repeating the step of providing the idle period after a scanning period in which the screen is scanned once is provided twice or more, the idle period is provided after the scanning period is provided an even number of times; and a potential of a pixel electrode and/or that of an opposite electrode of each of the pixels is/are controlled so that the pixel electrode and the opposite electrode develop a potential difference having a polarity which remains unchanged throughout the idle period and the scanning period which immediately follows the idle period and alternates from one scanning period to next for each scanning period before a next idle period.

6. The method as set forth in claim 1, wherein in repeating the step of providing the idle period after a scanning period in which the screen is scanned once is provided twice or more, a potential of a pixel electrode and/or that of an opposite electrode of each of the pixels is/are controlled so that the pixel electrode and the opposite electrode develop a potential difference having a polarity which differs in the idle period and in the scanning period which immediately follows the idle period and remains unchanged throughout scanning periods before a next idle period.

7. The method as set forth in claim 1, wherein the display apparatus is a liquid crystal display.

8. A method of driving a display apparatus including a screen which has pixels arranged in a matrix, said method producing a display by applying a scanning signal to scanning signal lines connected to the pixels and thus selecting a line to scan the screen and also by supplying a data signal to those pixels on the selected line via data signal lines, said method comprising the step of providing, when there is no change in an image to be displayed, an idle period in which all the scanning signal lines are caused to be in a non-scanning state for a period longer than a scanning period in which the screen is scanned once after the scanning period and when there has been a change in an image to be displayed, the idle period after the screen is scanned twice or more.

9. The method as set forth in claim 8, wherein when there has been a change in an image to be displayed, the idle period is provided after the scanning period is provided twice or more successive times.

10. The method as set forth in claim 8, wherein in the idle period, there is provided a suspension period in which a circuit irrelevant to display is stopped operating.

11. The method as set forth in claim 8, wherein:

in repeating the step of providing the idle period after the scanning period in which the screen is scanned once is provided twice or more, the idle period is provided after the scanning period is provided an odd number of times; and a potential of a pixel electrode and/or that of an opposite electrode of each of the pixels is/are controlled so that the pixel electrode and the opposite electrode develop a potential difference having a polarity which alternates from one scanning period to next.

12. The method as set forth in claim 8, wherein:

in repeating the step of providing the idle period after the scanning period in which the screen is scanned once is provided twice or more, the idle period is provided after the scanning period is provided an even number of times; and a potential of a pixel electrode and/or that of an opposite electrode of each of the pixels is/are controlled so that the pixel electrode and the opposite electrode develop a potential difference having a polarity which remains unchanged throughout the idle period and the scanning period which immediately follows the idle period and alternates from one scanning period to next for each scanning period before a next idle period.

13. The method as set forth in claim 8, wherein in repeating the step of providing the idle period after the scanning period in which the screen is scanned once is provided twice or more, a potential of a pixel electrode and/or that of an opposite electrode of each of the pixels is/are controlled so that the pixel electrode and the opposite electrode develop a potential difference having a polarity which differs in the idle period and in the scanning period which immediately follows the idle period and remains unchanged throughout scanning periods before a next idle period.

14. The method as set forth in claim 8, wherein the display apparatus is a liquid crystal display.

15. A method of driving a display apparatus including a screen which has pixels arranged in a matrix, said method producing a display by applying a scanning signal to scanning signal lines connected to the pixels and thus selecting a line to scan the screen at a predetermined rewrite cycle and also by supplying a data signal to those pixels on the selected line via data signal lines, said method comprising the step of scanning the screen at a rewrite cycle longer than the predetermined rewrite cycle when there is no change in an image to be displayed and at the predetermined rewrite cycle only when there has been a change in an image to be displayed.

16. The method as set forth in claim 15, wherein the screen is scanned twice or more at the predetermined rewrite cycle only when there has been a change in an image to be displayed.

17. A display apparatus including a screen which has pixels arranged in a matrix, said apparatus producing a display by applying a scanning signal to scanning signal lines connected to the pixels and thus selecting a line to scan the screen and also by supplying a data signal to those pixels on the selected line via data signal lines, said apparatus comprising control means for controlling drive of the display apparatus, wherein the control means causes all the scanning signal lines to be in a non-scanning state for a period longer than a time taken to scan the screen once after the screen is scanned twice or more.

18. The display apparatus as set forth in claim 17, wherein the control means causes all the scanning signal lines to be in a non-scanning state for a period longer than a scanning period in which the screen is scanned once after the scanning period in which the screen is scanned once is provided twice or more successive times.

19. The display apparatus as set forth in claim 17, wherein the control means provides a suspension period in which a circuit irrelevant to display is stopped operating in a period in which all the scanning signal lines are caused to be in a non-scanning state for a period longer than a scanning period in which the screen is scanned once.

20. The display apparatus as set forth in claim 17, wherein in repeating an operation of providing, after a scanning period in which the screen is scanned once is provided twice or more, an idle period in which all the scanning signal lines are caused to be in a non-scanning state for a period longer than the scanning period in which the screen is scanned once, the control means provides the idle period after the scanning period is provided an odd number of times and controls a potential of a pixel electrode and/or that of an opposite electrode of each of the pixels so that the pixel electrode and the opposite electrode develop a potential difference having a polarity which alternates from one scanning period to next.

21. The display apparatus as set forth in claim 17, wherein in repeating an operation of providing, after a scanning period in which the screen is scanned once is provided twice or more, an idle period in which all the scanning signal lines are caused to be in a non-scanning state for a period longer than the scanning period in which the screen is scanned once, the control means provides the idle period after the scanning period is provided an even number of times and controls a potential of a pixel electrode and/or that of an opposite electrode of each of the pixels so that the pixel electrode and the opposite electrode develop a potential difference having a polarity which remains unchanged throughout the idle period and the scanning period which immediately follows the idle period and alternates from one scanning period to next for each scanning period before a next idle period.

22. The display apparatus as set forth in claim 17, wherein in repeating an operation of providing, after a scanning period in which the screen is scanned once is provided twice or more, an idle period in which all the scanning signal lines are caused to be in a non-scanning state for a period longer than the scanning period in which the screen is scanned once, the control means controls a potential of a pixel electrode and/or that of an opposite electrode of each of the pixels so that the pixel electrode and the opposite electrode develop a potential difference having a polarity which differs in the idle period and in the scanning period which immediately follows the idle period and remains unchanged throughout scanning periods before a next idle period.

23. The display apparatus as set forth in claim 17, wherein the display apparatus is a liquid crystal display.

24. A display apparatus including a screen which has pixels arranged in a matrix, said apparatus producing a display by applying a scanning signal to scanning signal lines connected to the pixels and thus selecting a line to scan the screen and also by supplying a data signal to those pixels on the selected line via data signal lines, said apparatus comprising:

control means for controlling drive of the display apparatus; and detection means for detecting a change in an image to be displayed, wherein according to a result of the detection by the detection means, the control means causes, when there is no change in an image to be displayed, all the scanning signal lines to be in a non-scanning state for a period longer than a scanning period in which the screen is scanned once after the screen is scanned once and, when there has been a change in an image to be displayed, all the scanning signal lines to be in a non-scanning state for a period longer than a scanning period in which the screen is scanned once after the screen is scanned twice or more.

25. The display apparatus as set forth in claim 24, wherein the control means causes, when there has been a change in an image to be displayed, all the scanning signal lines to be in a non-scanning state for a period longer than the scanning period in which the screen is scanned once after the scanning period in which the screen is scanned once is provided twice or more successive times.

26. The display apparatus as set forth in claim 24, wherein the control means provides a suspension period in which a circuit irrelevant to display is stopped operating in a period in which all the scanning signal lines are caused to be in a non-scanning state for a period longer than the scanning period in which the screen is scanned once.

27. The display apparatus as set forth in claim 24, wherein in repeating an operation of providing, after the scanning period in which the screen is scanned once is provided twice or more, an idle period in which all the scanning signal lines are caused to be in a non-scanning state for a period longer than the scanning period in which the screen is scanned once, the control means provides the idle period after the scanning period is provided an odd number of times and controls a potential of a pixel electrode and/or and that of opposite electrode of each of the pixels so that the pixel electrode and the opposite electrode develop a potential difference having a polarity which alternates from one scanning period to next.

28. The display apparatus as set forth in claim 24, wherein in repeating an operation of providing, after the scanning period in which the screen is scanned once is provided twice or more, an idle period in which all the scanning signal lines are caused to be in a non-scanning state for a period longer than the scanning period in which the screen is scanned once, the control means provides the idle period after the scanning period is provided an even number of times and controls a potential of a pixel electrode and/or that of an opposite electrode of each of the pixels so that the pixel electrode and the opposite electrode develop a potential difference having a polarity which remains unchanged throughout the idle period and the scanning period which immediately follows the idle period and alternates from one scanning period to next for each scanning period before a next idle period.

29. The display apparatus as set forth in claim 24, wherein in repeating an operation of providing, after the scanning period in which the screen is scanned once is provided twice or more, an idle period in which all the scanning signal lines are caused to be in a non-scanning state for a period longer than the scanning period in which the screen is scanned once, the control means controls a potential of a pixel electrode and/or that of an opposite electrode of each of the pixels so that the pixel electrode and the opposite electrode develop a potential difference having a polarity which differs in the idle period and in the scanning period which immediately follows the idle period and remains unchanged throughout scanning periods before a next idle period.

30. The display apparatus as set forth in claim 24, wherein the display apparatus is a liquid crystal display.

31. A display apparatus including a screen which has pixels arranged in a matrix, said apparatus producing a display by applying a scanning signal to scanning signal lines connected to the pixels and thus selecting a line to scan the screen at a predetermined rewrite cycle and also by supplying a data signal to those pixels on the selected line via data signal lines, said apparatus comprising:

control means for controlling drive of the display apparatus; and detection means for detecting a change in an image to be displayed, wherein the control means controls application of the scanning signal to the scanning signal lines according to a result of the detection by the detection means so that the screen is scanned at a rewrite cycle longer than the predetermined rewrite cycle when there is no change in an image to be displayed and at the predetermined rewrite cycle only when there has been a change in an image to be displayed.

32. The display apparatus as set forth in claim 31, wherein the control means controls application of the scanning signal to the scanning signal line according to a result of the detection by the detection means so that the screen is scanned twice or more at the predetermined rewrite cycle only when there has been a change in an image to be displayed.

* * * * *